US009123191B2

(12) United States Patent
Shimizu et al.

(10) Patent No.: US 9,123,191 B2
(45) Date of Patent: Sep. 1, 2015

(54) MONEY DEPOSITING/DISPENSING DEVICE AND MONEY MANAGEMENT METHOD OF MONEY DEPOSITING/DISPENSING DEVICE

(71) Applicant: GLORY LTD., Himeji-shi, Hyogo (JP)

(72) Inventors: Tadashi Shimizu, Hyogo (JP); Kazuya Nishino, Hyogo (JP); Kento Ueda, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 14/093,139

(22) Filed: Nov. 29, 2013

(65) Prior Publication Data

US 2014/0144750 A1 May 29, 2014

(30) Foreign Application Priority Data

Nov. 28, 2012 (JP) ..... 2012-259992

(51) Int. Cl.

| | |
|---|---|
| ***G06M 1/00*** | (2006.01) |
| ***G06M 3/00*** | (2006.01) |
| ***G07F 9/08*** | (2006.01) |
| ***G07D 11/00*** | (2006.01) |

(52) U.S. Cl.

CPC ..... *G07D 11/0021* (2013.01); *G07D 11/0054* (2013.01); *G07D 11/0069* (2013.01); (Continued)

(58) Field of Classification Search

CPC ..... G07F 5/18; G07F 5/22; G07F 5/24; G07F 17/42; G07F 9/08; G07F 19/20; G07F 19/209; G07D 1/04; G07D 11/0051; G07D 11/0054; G07D 11/0057; G07D 11/006; G07D 11/0066; G07D 11/0069; G07D 11/0072; G07D 11/0075

USPC ..... 194/206, 207, 215–217; 209/534; 235/379; 382/135

See application file for complete search history.

(56) References Cited

U.S. PATENT DOCUMENTS

| | | | | |
|---|---|---|---|---|
| 8,701,858 | B2 * | 4/2014 | Iwamura et al. | 194/206 |
| 2005/0004869 | A1 * | 1/2005 | Leurig | 705/40 |

(Continued)

FOREIGN PATENT DOCUMENTS

| | | |
|---|---|---|
| EP | 2 515 279 A1 | 10/2012 |
| JP | 2000-123219 | 4/2000 |

(Continued)

OTHER PUBLICATIONS

European Search Report (Application No. 13194753.3) (7 pages—dated Feb. 14, 2013).

*Primary Examiner* — Jeffrey Shapiro

(74) *Attorney, Agent, or Firm* — Renner, Kenner, Greive, Bobak, Taylor & Weber

(57) ABSTRACT

A money depositing/dispensing device includes an inventory amount obtaining unit, a virtual inventory amount setting unit, and a device inventory amount management unit. The inventory amount obtaining unit is configured to count money to be stored in a storage unit and count money fed from the storage unit, thereby successively obtaining an inventory amount in the storage unit. The virtual inventory amount setting unit is configured to set an inventory amount of banknotes which are not present in the device but should be treated as money present in the device, as a virtual inventory amount. The device inventory amount management unit is configured to manage, as an inventory amount in the device, a sum of the inventory amount in the obtained by the storage unit inventory amount obtaining unit and the virtual inventory amount set by the virtual inventory amount setting unit.

18 Claims, 10 Drawing Sheets

(52) U.S. Cl.
CPC ..... *G07D11/0072* (2013.01); *G07D 11/0075* (2013.01); *G07D 11/0084* (2013.01); *G07D 11/0066* (2013.01)

(56) References Cited

U.S. PATENT DOCUMENTS

| | | | | |
|---|---|---|---|---|
| 2009/0216666 | A1* | 8/2009 | Antao et al. | 705/30 |
| 2009/0229947 | A1* | 9/2009 | Takai et al. | 194/206 |
| 2010/0213661 | A1 | 8/2010 | Fukazawa et al. | |
| 2011/0106681 | A1* | 5/2011 | Cockerell et al. | 705/35 |
| 2012/0189186 | A1* | 7/2012 | Csulits et al. | 382/135 |
| 2012/0305362 | A1* | 12/2012 | Iwamura et al. | 194/206 |
| 2014/0244500 | A1* | 8/2014 | Elias | 705/43 |

FOREIGN PATENT DOCUMENTS

| | | |
|---|---|---|
| JP | 2009-151354 | 7/2009 |
| JP | 2010-72812 | 4/2010 |
| WO | WO 2011/036782 | 3/2011 |

* cited by examiner

FIG.9

| | | INVENTORY AMOUNT IN DEVICE (A) | | | | | | INVENTORY AMOUNT IN STORAGE UNIT (B) | | | | | | VIRTUAL INVENTORY AMOUNT (C) | | | | | | INVENTORY AMOUNT IN ESCROW UNIT (D) | | | | | |
|---|---|---|---|---|---|---|---|---|---|---|---|---|---|---|---|---|---|---|---|---|---|---|---|---|---|
| | | | | | | | | CASSETTE 1 | CASSETTE 2 | CASSETTE 3 | CASSETTE 4U | CASSETTE 4L | CASSETTE 5 | | | | | | | | | | | | |
| | | $1 | $5 | $10 | $20 | $50 | $100 | $1 | $5 | $10 | $20 | $50 | $100 | $1 | $5 | $10 | $20 | $50 | $100 | $1 | $5 | $10 | $20 | $50 | $100 |
| | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | DEPOSITING $1x10,$5x20,$10x30 $20x40,$50x50,$100x60 | 10 | 20 | 30 | 40 | 50 | 60 | 10 | 20 | 30 | 40 | 50 | 60 | 0 | 0 | 0 | 0 | 0 | 0 | 0 | 0 | 0 | 0 | 0 | 0 |
| 2 | DISPENSING $20 × 20 | 10 | 20 | 30 | 20 | 50 | 60 | 10 | 20 | 30 | 15 | 50 | 60 | 0 | 0 | 0 | 0 | 0 | 0 | 0 | 0 | 0 | 5 | 0 | 0 |
| 3 | ERROR OCCURS DURING DEPOSITING $1 × 10 | 10 | 20 | 30 | 20 | 50 | 60 | 15 | 20 | 30 | 15 | 50 | 60 | 0 | 0 | 0 | 0 | 0 | 0 | 0 | 0 | 0 | 5 | 0 | 0 |
| | REMOVE JAMMED BANKNOTE AND RESET | 10 | 20 | 30 | 20 | 50 | 60 | *15 | 20 | 30 | 15 | 50 | 60 | 0 | 0 | 0 | 0 | 0 | 0 | 0 | 0 | 0 | 5 | 0 | 0 |
| | DISCHARGE BANKNOTE STORED IN ESCROW UNIT TO PERFORM PARTIAL RECONCILIATION | 10 | 20 | 30 | 20 | 50 | 60 | *15 | 20 | 30 | 15 | 50 | 60 | 0 | 0 | 0 | 0 | 0 | 0 | 0 | 0 | 0 | 5 | 0 | 0 |
| | PERFORM PARTIAL RECONCILIATION | 10 | 20 | 30 | 20 | 50 | 60 | 16 | 20 | 30 | 15 | 50 | 60 | 0 | 0 | 0 | 0 | 0 | 0 | 0 | 0 | 0 | 5 | 0 | 0 |
| | PERFORM RETURNING PROCESS | 10 | 20 | 30 | 20 | 50 | 60 | 20 | 20 | 30 | 15 | 50 | 60 | 0 | 0 | 0 | 0 | 0 | 0 | 0 | 0 | 0 | 5 | 0 | 0 |
| | SET VIRTUAL INVENTORY AMOUNT | 20 | 20 | 30 | 20 | 50 | 60 | 20 | 20 | 30 | 15 | 50 | 60 | 0 | 0 | 0 | 0 | 0 | 0 | 0 | 0 | 0 | 5 | 0 | 0 |

FIG.10

| | | INVENTORY AMOUNT IN DEVICE (A) | | | | | | INVENTORY AMOUNT IN STORAGE UNIT (B) | | | | | | VIRTUAL INVENTORY AMOUNT (C) | | | | | | INVENTORY AMOUNT IN ESCROW UNIT (D) | | | | | |
|---|---|---|---|---|---|---|---|---|---|---|---|---|---|---|---|---|---|---|---|---|---|---|---|---|---|
| | | | | | | | | CASSETTE 1 | CASSETTE 2 | CASSETTE 3 | CASSETTE 4U | CASSETTE 4L | CASSETTE 5 | | | | | | | | | | | | |
| | | $1 | $5 | $10 | $20 | $50 | $100 | $1 | $5 | $10 | $20 | $50 | $100 | $1 | $5 | $10 | $20 | $50 | $100 | $1 | $5 | $10 | $20 | $50 | $100 |
| | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | DEPOSITING $1x10,$5x20,$10x30 $20x40,$50x50,$100x60 | 10 | 20 | 30 | 40 | 50 | 60 | 10 | 20 | 30 | 40 | 50 | 60 | 0 | 0 | 0 | 0 | 0 | 0 | 0 | 0 | 0 | 0 | 0 | 0 |
| 2 | DISPENSING $20 × 20 | 10 | 20 | 30 | 20 | 50 | 60 | 10 | 20 | 30 | 15 | 50 | 60 | 0 | 0 | 0 | 0 | 0 | 0 | 0 | 0 | 0 | 5 | 0 | 0 |
| 3 | ERROR OCCURS DURING DISPENSING $1 × 10 | 10 | 20 | 30 | 20 | 50 | 60 | 4 | 20 | 30 | 15 | 50 | 60 | 0 | 0 | 0 | 0 | 0 | 0 | 1 | 0 | 0 | 5 | 0 | 0 |
| | REMOVE JAMMED BANKNOTE AND RESET | 10 | 20 | 30 | 20 | 50 | 60 | *4 | 20 | 30 | 15 | 50 | 60 | 0 | 0 | 0 | 0 | 0 | 0 | 1 | 0 | 0 | 5 | 0 | 0 |
| | DISCHARGE BANKNOTE STORED IN ESCROW UNIT TO PERFORM PARTIAL RECONCILIATION | 10 | 20 | 30 | 20 | 50 | 60 | *4 | 20 | 30 | 15 | 50 | 60 | 0 | 0 | 0 | 0 | 0 | 0 | 0 | 0 | 0 | 5 | 0 | 0 |
| | PERFORM PARTIAL RECONCILIATION | 10 | 20 | 30 | 20 | 50 | 60 | 4 | 20 | 30 | 15 | 50 | 60 | 0 | 0 | 0 | 0 | 0 | 0 | 0 | 0 | 0 | 5 | 0 | 0 |
| | PERFORM RETURNING PROCESS | 10 | 20 | 30 | 20 | 50 | 60 | 9 | 20 | 30 | 15 | 50 | 60 | 0 | 0 | 0 | 0 | 0 | 0 | 0 | 0 | 0 | 5 | 0 | 0 |
| | SET VIRTUAL INVENTORY AMOUNT | 10 | 20 | 30 | 20 | 50 | 60 | 9 | 20 | 30 | 15 | 50 | 60 | 1 | 0 | 0 | 0 | 0 | 0 | 0 | 0 | 0 | 5 | 0 | 0 |

MONEY DEPOSITING/DISPENSING DEVICE AND MONEY MANAGEMENT METHOD OF MONEY DEPOSITING/DISPENSING DEVICE

CROSS-REFERENCE TO RELATED APPLICATION

This application claims priority to Japanese Patent Application No. 2012-259992 filed on Nov. 28, 2012, the entire disclosure of which is incorporated by reference herein.

BACKGROUND

Japanese Unexamined Patent Publication No. 2009-151354 relates to a banknote depositing/dispensing machine used, for example, in financial institutions, and discloses performing a reconciliation process in which an inventory amount of a storage unit is checked by counting banknotes when all the banknotes stored in a storage unit and fed from the storage unit are temporarily stored in another storage unit, or when the banknotes are restored in the original storage unit from the another storage unit. As mentioned in the above publication, such a reconciliation process enables the inventory amount of the storage unit to be checked against transaction data, such as depositing and dispensing money.

Japanese Unexamined Patent Publication No. 2010-72812 relates to a money depositing/dispensing device, such as a banknote change machine and a coin change machine connected to a POS register, and discloses performing a money returning process when an error occurs in a depositing process or a dispensing process. The returning process is a process conducted after the recovery of the depositing/dispensing machine, which is temporarily stopped after the occurrence of an error and recovered by an operator by removing money remaining in the device. In the returning process, the operator places money to be processed in the returning process, including the removed money, in an inlet, and the depositing/dispensing machine stores the placed money, while counting the money. The depositing/dispensing machine described in this publication controls first inventory amount data indicating an inventory amount of the money in the device, including money in a storage unit, and second inventory amount data indicating an inventory amount of money in the storage unit. In the returning process, only the second inventory amount data is updated based on the result of counting the money placed in the inlet until the first inventory amount data and the second inventory amount data match. After the first inventory amount data and the second inventory amount data match, both of the first and second inventory amount data are updated based on the result of counting the money placed in the inlet. This is how the depositing/dispensing device avoids miscalculation.

However, even if a returning process is necessary because an error, such as a banknote jam, has occurred in the depositing process or the dispensing process and the process is therefore stopped, as in the depositing/dispensing device of Japanese Unexamined Patent Publication No. 2010-72812, it might happen that the banknote cannot be returned in the device because it is torn. In such a case, a substitutive banknote is prepared in place of the torn banknote, and the substitutive banknote is stored in the storage unit by the returning process, in conventional techniques. However, the error recovery of the depositing/dispensing device may be delayed unless the substitutive banknote is immediately prepared. When the depositing/dispensing device is located at the teller counters in financial institutions, for example, the delay in error recovery may cause delay in the teller's business.

This problem is caused by a difference between an inventory amount in device managed by the depositing/dispensing device and an actual inventory amount of the banknotes present in the device, e.g., a storage unit. In the conventional depositing/dispensing devices, the difference between these inventory amounts has to be eliminated by storing the banknotes in a storage unit. However, if it is possible to allow the difference between these inventory amounts, while achieving accurate management of the inventory amount in the depositing/dispensing device, an error, if it occurs, may be recovered more rapidly.

According to the techniques disclosed herein, a money depositing/dispensing device which performs a money depositing process and a money dispensing process can accurately manage an inventory amount in device, while allowing the difference between the inventory amount in device and an actual inventory amount.

SUMMARY

According to the techniques disclosed herein, an inventory amount of money which is, for various reasons, not present in the depositing/dispensing device, but should be treated as money present in the device is regarded as a virtual inventory amount, and the sum of an inventory amount of a storage unit and the virtual inventory amount is managed as an inventory amount in device. The inventory amount in device is thereby accurately managed, while allowing a difference between the inventory amount in device and the actual inventory amount.

Specifically, the techniques disclosed herein relate to a money depositing/dispensing device which performs at least a depositing process and a dispensing process of money. The money depositing/dispensing device includes: at least one storage unit provided in a device and configured to store the money and feed the stored money; an inventory amount obtaining unit configured to count the money to be stored in the storage unit and count the money fed from the storage unit, thereby successively obtaining an inventory amount in the storage unit; a virtual inventory amount setting unit configured to set an inventory amount of the money which is not present in the device but should be treated as money present in the device, as a virtual inventory amount; and a device inventory amount management unit configured to manage, as an inventory amount in the device, a sum of the inventory amount in the storage unit obtained by the inventory amount obtaining unit and the virtual inventory amount set by the virtual inventory amount setting unit.

BRIEF DESCRIPTION OF THE DRAWINGS

FIG. 9 is a table for explaining an example transition of an inventory amount in device, an inventory amount in storage unit, a virtual inventory amount, and an inventory amount in escrow unit, in the event of interruption of the depositing process.

FIG. 10 is a table for explaining an example transition of an inventory amount in device, an inventory amount in storage unit, a virtual inventory amount, and an inventory amount in escrow unit, in the event of interruption of the dispensing process.

DETAILED DESCRIPTION

Figure 1:
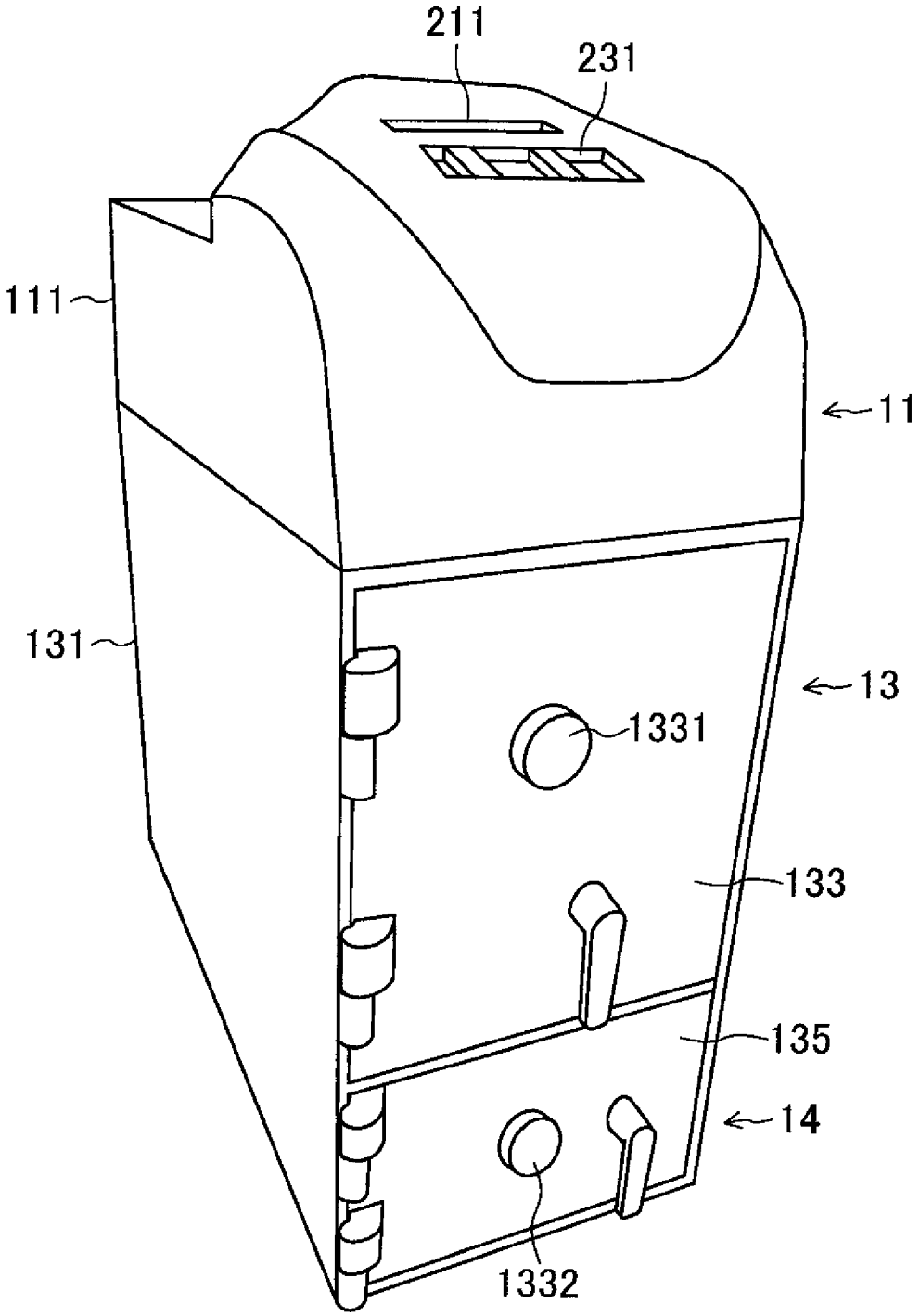
FIG. 1 is a schematic oblique view of a banknote depositing/dispensing machine.

Specifically, the techniques disclosed herein relate to a money depositing/dispensing device which performs at least a depositing process and a dispensing process of money. The money depositing/dispensing device includes: at least one storage unit provided in a device and configured to store the money and feed the stored money; an inventory amount obtaining unit configured to count the money to be stored in the storage unit and count the money fed from the storage unit, thereby successively obtaining an inventory amount in the storage unit; a virtual inventory amount setting unit configured to set an inventory amount of the money which is not present in the device but should be treated as money present in the device, as a virtual inventory amount; and a device inventory amount management unit configured to manage, as an inventory amount in the device, a sum of the inventory amount in the storage unit obtained by the inventory amount obtaining unit and the virtual inventory amount set by the virtual inventory amount setting unit.

The virtual inventory amount setting unit may automatically set the virtual inventory amount, based on an inventory amount in the storage unit confirmed by, for example, performing a predetermined process, or the virtual inventory amount may be manually input by an operator via an operation unit, as will be described later.

According to the above configurations, the inventory amount obtaining unit counts the money to be stored in the storage unit (e.g., the money to be stored in the storage unit in a depositing process) and counts the money fed from the storage unit (e.g., the money fed from the storage unit in a dispensing process), thereby obtaining an inventory amount in the storage unit. Further, the virtual inventory amount setting unit sets an inventory amount of money which is not present in the device but should be treated as money present in the device, as a virtual inventory amount. In this device, the sum of the inventory amount in the storage unit and the virtual inventory amount is managed as an inventory amount in the device. Therefore, if there is a difference between the inventory amount in the device and an actual inventory amount, the difference is considered as the virtual inventory amount, and thus it is possible to accurately manage the inventory amount in the device. Due to this configuration, even if there is a difference between the inventory amount in the device and the actual inventory amount for various reasons, the difference is allowed and the operation of the depositing/dispensing device can be continued. As will be described later, when, for example, a depositing process or a dispensing process is interrupted by an error which occurred in the process, error recovery can be immediately completed. If the virtual inventory amount is zero, it means that the inventory amount in the storage unit and the inventory amount in the device are equal to each other.

The money depositing/dispensing device may further include: an inventory amount confirmation unit configured to confirm the inventory amount in the storage unit by performing a predetermined process; and an inventory amount comparison unit configured to compare the inventory amount in the storage unit obtained by the inventory amount obtaining unit before the inventory amount confirmation unit performs the predetermined process, and an inventory amount in the storage unit confirmed by the predetermined process, wherein if the comparison by the inventory amount comparison unit results in that the inventory amount in the storage unit confirmed by the predetermined process is smaller than the inventory amount in the storage unit obtained by the inventory amount obtaining unit, the virtual inventory amount setting unit sets a difference between the inventory amounts as the virtual inventory amount.

If there is a difference between the inventory amount in the storage unit obtained before a predetermined process for confirming the inventory amount in the storage unit, and the inventory amount in the storage unit confirmed by the predetermined process, it means that there is a difference between the inventory amount in the device and the actual inventory amount of the money present in the device, e.g., in the storage unit. If the inventory amount in the storage unit confirmed by the predetermined process is smaller than the inventory amount in the storage unit obtained before the predetermined process, the money equivalent to the difference is considered as money which is not present in the device for some reason but should be treated as money present in the device. The difference is set as a virtual inventory amount, which makes it possible to accurately manage the inventory amount in the device, while allowing the difference between the inventory amount in the device and the actual inventory amount.

In the money depositing/dispensing device, if the comparison by the inventory amount comparison unit results in that the inventory amount in the storage unit confirmed by the predetermined process is larger than the inventory amount in the storage unit obtained by the inventory amount obtaining unit, the device inventory amount management unit may determine that a depositing process equivalent to a difference between the inventory amounts has been performed, and update the inventory amount in the device.

If the inventory amount in the storage unit confirmed by the predetermined process is larger than the inventory amount in the storage unit obtained before the predetermined process, it means that the inventory amount of money actually stored in the storage unit is larger than the inventory amount in the device. Thus, to make the inventory amount in the device match the actual inventory amount, it is determined that a depositing process equivalent to the difference has been performed, and the inventory amount in the device is updated. It is therefore possible to accurately manage the inventory amount in the device.

The inventory amount confirmation unit may perform a reconciliation process for checking the inventory amount in the storage unit by feeding at least part of the money stored in the storage unit, and the predetermined process includes the reconciliation process.

Performing the reconciliation process makes it possible to know the accurate inventory amount of money actually stored in the storage unit. Thus, it is advantageous in setting an accurate virtual inventory amount, and managing the inventory amount in the device with accuracy.

When the depositing process or the dispensing process is interrupted by an error which occurred in the process, the inventory amount confirmation unit may perform the reconciliation process after recovery from a cause of the error.

If a depositing process or a dispensing process is interrupted by, for example, a money (e.g., a banknote) jam which occurred in the device during the process, a reconciliation process is performed after recovery from a cause of the error by removing the jammed money. The reconciliation process checks the inventory amount of the money stored in the storage unit whose inventory amount becomes uncertain between the occurrence of the error and the completion of the error recovery.

The inventory amount in the storage unit obtained before the interrupted process, in other words, before the reconciliation process is performed, and the inventory amount in the storage unit obtained as a result of the reconciliation process are compared. If the two inventory amounts match each other, the operation of the depositing/dispensing device can be continued because it means that the inventory amount in the device and the inventory amount of money actually stored in the storage unit are equal to each other. If the inventory amount in the storage unit obtained before the interrupted process and the inventory amount in the storage unit obtained as a result of the reconciliation process do not match, the operation of the depositing/dispensing device cannot be continued.

Specifically, if the inventory amount in the storage unit obtained as a result of the reconciliation process is smaller than the inventory amount in the storage unit obtained before the interrupted process, it means that there exists the above-described money which is not present in the device but should be treated as money present in the device. Thus, the difference is set as the virtual inventory amount. On the other hand, if the inventory amount in the storage unit obtained as a result of the reconciliation process is larger than the inventory amount in the storage unit obtained before the interrupted process, it is determined that a depositing process equivalent to the difference has been performed, and the inventory amount in the device is updated.

As a result, the operation of the depositing/dispensing device can be recovered early, while accurately managing the inventory amount in the device, when a depositing process or a dispensing process is interrupted by an error which occurred in the process.

After completion of the reconciliation process, the inventory amount confirmation unit may perform a returning process in which money present outside the device is placed in an inlet again, and the money placed in the inlet is stored in the storage unit while counting the money, and the predetermined process includes the returning process.

The money present outside the device after the recovery from interruption of a depositing process includes money removed from the device and money which should have been deposited. Thus, by performing a returning process in which the money present outside the device is stored in the storage unit, the depositing/dispensing device will be in a state equivalent to the state after the depositing process. On the other hands, the money present outside the device after the recovery from interruption of a dispensing process includes money removed from the device and money which has already been dispensed before the interruption. Thus, by performing a returning process in which the money present outside the device is stored in the storage unit, the depositing/dispensing device will be in a state equivalent to the state before the dispensing process. In either case, if the sum of the inventory amount in the storage unit equivalent to a result of reconciliation and the inventory amount counted in the returning process is smaller, after the returning process, than the inventory amount in the storage unit which was obtained before the interruption, it means that there exists money which is not present in the device for some reason but should be treated as money present in the device. Thus, the difference (in this case, the sum of the inventory amount in the storage unit equivalent to a result of reconciliation and the inventory amount counted in the returning process is subtracted from the inventory amount in the storage unit which was obtained before the interruption) may be equivalent to the virtual inventory amount. On the other hand, if the sum of the inventory amount in the storage unit equivalent to a result of reconciliation and the inventory amount counted in the returning process is larger than the inventory amount in the storage unit which was obtained before the interruption, it is determined that a money depositing process equivalent to the difference has been performed, and the inventory amount in the device may be updated.

The money may be a banknote; the money depositing/dispensing device may further include a list management unit configured to manage a code list in which unique codes of the respective banknotes are listed in an order of the banknotes stored in the storage unit; and in the reconciliation process, part of the banknotes stored in the storage unit may be fed, and the unique codes of the fed banknotes may be checked against the code list, thereby checking an inventory amount of the banknotes stored in the storage unit after the feed of the banknotes.

Due to this configuration, it is not necessary to feed all the banknotes stored in the storage unit in the reconciliation process. Thus, the time necessary for performing the reconciliation process is reduced. This is advantageous for early recovery of the depositing/dispensing device when a depositing process or a dispensing process is interrupted by an error, for example.

The money depositing/dispensing device may further include: a communication unit configured to communicate with a higher-ranking device, wherein the device inventory amount management unit sends information about the inventory amount in the device to the higher-ranking device via the communication unit, without differentiating between the inventory amount in the storage unit and the virtual inventory amount.

Due to this configuration, even if the virtual inventory amount is set in the money depositing/dispensing device, the higher-ranking device, which is an external device of the money depositing/dispensing device, performs various processes without recognizing the virtual inventory amount.

Alternatively, unlike the above configuration, the device inventory amount management unit may send information about the inventory amount in the device to the higher-ranking device via the communication unit, while differentiating between the inventory amount in the storage unit and the virtual inventory amount.

Due to this configuration, not only the money depositing/dispensing device, but also the higher-ranking device acquire the virtual inventory amount as money which is not actually present in the money depositing/dispensing device but should be present in the device.

The techniques disclosed herein includes a money management method of a money depositing/dispensing device which performs at least a depositing process and a dispensing process of money. The method includes: counting the money to be stored in a storage unit provided in a device and counting the money fed from the storage unit, thereby successively obtaining an inventory amount in the storage unit; setting an inventory amount of the money which is not present in the device but should be treated as money present in the device, as a virtual inventory amount; and managing, as an inventory amount in the device, a sum of the obtained inventory amount in the storage unit and the virtual inventory amount which has been set.

Since the sum of the inventory amount in the storage unit and the virtual inventory amount is managed as an inventory amount in the device, it is possible to manage the inventory amount in the device with accuracy, while allowing the difference between the inventory amount in the device and the actual inventory amount.

An embodiment of a money depositing/dispensing device will be described below with reference to the drawings. The following embodiment will be described merely as an example. FIG. 1 shows appearance of a banknote depositing/dispensing machine (hereinafter simply referred to as a depositing/dispensing machine) 1. The depositing/dispensing machine 1 is placed at a teller counter of a bank, for example, and shared for use by two tellers, with the depositing/dispensing machine 1 interposed therebetween. Thus, the depositing/dispensing machine 1 basically has a symmetrical structure.

As described in detail later, the depositing/dispensing machine 1 at least performs a depositing process for storing banknotes placed in an inlet 211 in a storage unit 3, and a dispensing process for dispensing the banknotes stored in the storage unit 3 to an outlet 231. The depositing/dispensing machine 1 is a so-called circulating depositing/dispensing machine. The banknotes dispensed in the dispensing process include the banknotes stored in the storage unit 3 in the depositing process.

Figure 2:
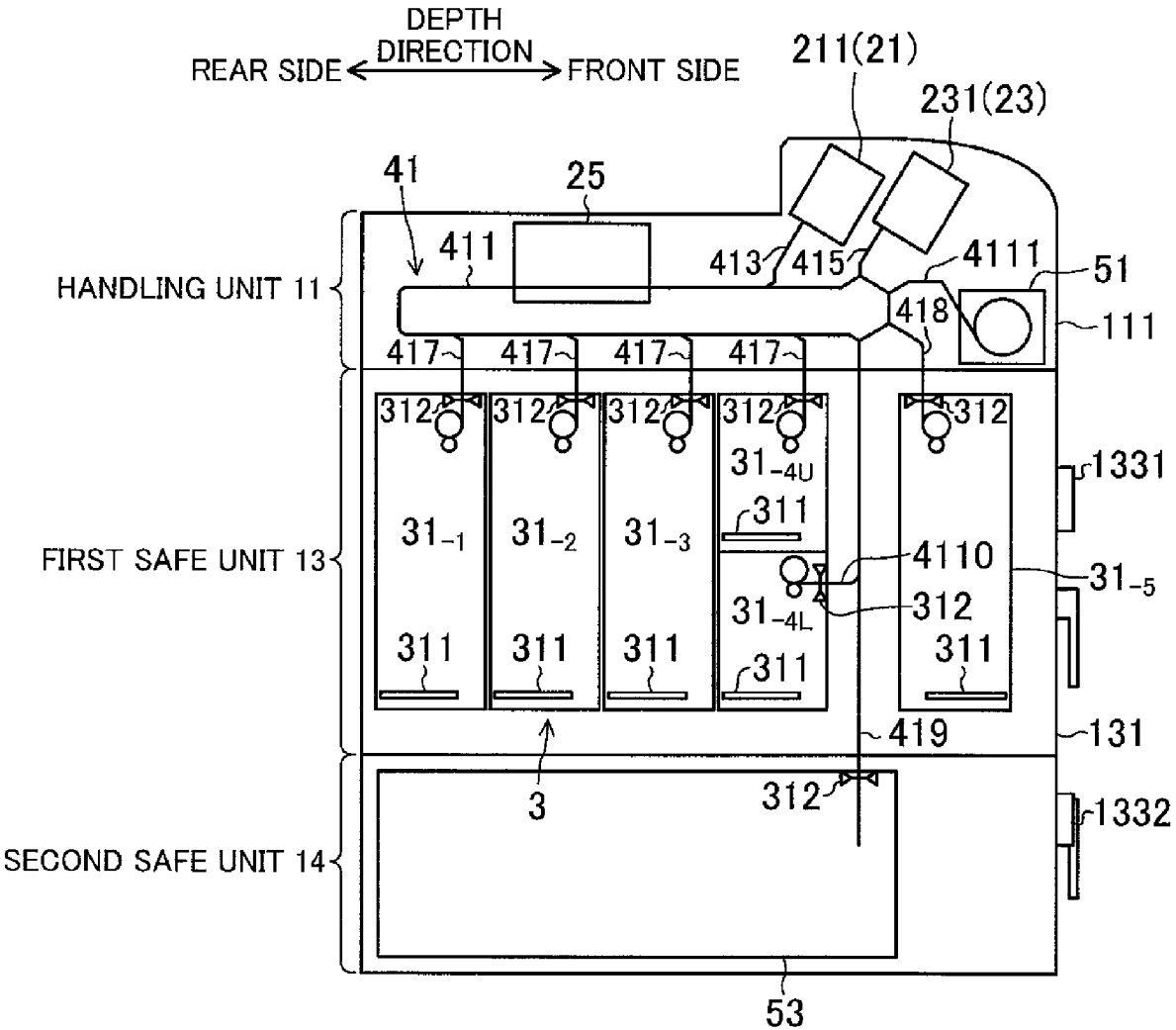
FIG. 2 is a schematic view of an internal structure of the banknote depositing/dispensing machine.

As shown in FIGS. 1 and 2, the depositing/dispensing machine 1 is broadly divided into an upper handling unit 11, a first safe unit 13 in the middle, and a lower second safe unit 14. A casing 111 constituting the handling unit 11 contains a depositing unit 21 having the inlet 211, a dispensing unit 23 having the outlet 231, a recognition unit 25 configured to recognize the banknotes, a rejected banknote escrow unit (hereinafter sometimes simply referred to as an escrow unit) 51 for temporarily storing the banknotes, and a transport unit 41 which includes a looped transport path 411 connecting the depositing unit 21, the dispensing unit 23, the recognition unit 25, and the escrow unit 51. A casing 131 arranged below the casing 111 constituting the handling unit 11 constitutes the first and second safe units 13 and 14, and is a protective casing 131 configured to protect the storage unit 3 etc. contained therein at a predetermined security level or higher.

The first safe unit 13 contains the storage unit 3 including a plurality of stacking storage cassettes 31 (5 cassettes in an example shown in the drawings). The second safe unit 14 contains a collection cassette 53. A first door 133 for opening and closing the first safe unit 13, and a second door 135 for opening and closing the second safe unit 14 are provided in a front surface of the protective casing 131. Access to the first safe unit 13 and access to the second safe unit 14 are authorized to different persons by providing electronic locks 1331 and 1332 different from each other on the first and second doors 133 and 135.

As described above, the inlet 211 of the depositing unit 21 is a port in which the banknotes to be deposited are placed in the depositing process, for example. The inlet 211 is open upward in an upper surface of the casing 111, and can receive a plurality of banknotes at a time. The depositing unit 21 includes a feeding mechanism for feeding the plurality of banknotes placed in the inlet 211 one by one to the looped transport path 411.

As described above, the outlet 231 of the dispensing unit 23 is a port to which the banknotes are dispensed in the dispensing process, for example. The outlet 231 is located forward of the inlet 211 (on the right of the inlet in FIG. 2) and is open obliquely upward at a position between the upper surface and a front surface of the casing 111. The outlet 231 can accumulate the transported banknotes, and can hold a plurality of banknotes at a time.

The recognition unit 25 is provided on the looped transport path 411 to recognize authenticity, fitness, and denomination of each of the banknotes transported on the looped transport path 411. Specifically, the recognition unit 25 includes a sensor for detecting the feature of each banknote, such as an image sensor, an infrared sensor, an ultraviolet sensor, or a magnetometric sensor, to determine whether the feature of the transported banknote matches the feature of the banknote stored in a memory, thereby recognizing the authenticity, fitness, and denomination of each banknote. The recognition unit 25 can optically read a serial number printed on each of the banknotes. To read the serial number is to obtain an image of the serial number printed on a predetermined position of the banknote, and to recognize letters or numerals of the serial number based on the obtained image. Instead of the recognition unit 25, another reading unit may be provided on the looped transport path 411, for example, to read the serial number. A control unit 513 described later may have functions of the recognition unit 25 except for the function as a sensor.

The transport unit 41 includes the looped transport path 411 endlessly running in the casing 111. The banknotes are transported on the looped transport path 411 clockwise and counterclockwise in FIG. 2. Although not shown, the looped transport path 411 includes a combination of a plurality of rollers, belts, motors for driving them, sensors for detecting the transported banknotes, and guides. The looped transport path 411 allows long edge feed of the banknotes one by one with a predetermined gap kept between the banknotes.

The looped transport path 411 and the inlet 211 are connected through a depositing path 413, and the banknotes placed in the inlet 211 are transported to the looped transport path 411 through the depositing path 413.

To the looped transport path 411, four branch paths 417 connected to the four storage cassettes 31, respectively, are connected through diverters (not shown). Due to operation of the diverters, the banknotes traveling on the looped transport path 411 are selectively transported to any one of the four storage cassettes 31 through the branch path 417, and stored therein, and the banknotes fed from any one of the storage cassettes 31 are transported to the looped transport path 411 through the branch path 417.

To the looped transport path 411, a dispensing path 415 is connected through a diverter (not shown) which changes the traveling direction of the banknotes. An end of the dispensing path 415 is connected to the outlet 231. The diverter is positioned at a junction of three transport paths extending in different directions, and selectively transports the banknotes traveling from one of the transport paths to the other two transport paths. Details of the diverter are described in International Patent Publication WO2009/034758. In this configuration, the banknotes traveling on the looped transport path 411 are selectively transported to the outlet 231 through the dispensing path 415 by the operation of the diverter.

To the looped transport path 411, a first connection path 418 connected to a fifth storage cassette $\mathbf{31}_{_5}$ described later, and a second connection path 419 connected to the collection cassette 53 are connected through diverters (not shown), respectively. The second connection path 419 vertically penetrates the first safe unit 13, and is provided with a branch path 4110. The branch path 4110 is connected to a lower fourth storage cassette $\mathbf{31}_{_4L}$ described later.

The diverters are positioned at junctions of the first connection path 418 and the second connection path 419, respectively. Each of the diverters is positioned at a junction of three transport paths extending in different directions, and selectively transports the banknotes traveling from one of the transport paths to the other two transport paths. In this configuration, the banknotes traveling on the looped transport path 411 clockwise or counterclockwise are selectively transported to the fifth storage cassette $\mathbf{31}_{-5}$ through the first connection path 418, or to the lower fourth storage cassette $\mathbf{31}_{-4L}$ or the collection cassette 53 through the second connection path 419, by the operation of the diverter. The banknotes fed from the fifth storage cassette $\mathbf{31}_{-5}$ or the lower fourth storage cassette $\mathbf{31}_{-4L}$, and passed through the first or second connection path 418 or 419 are transported through the looped transport path 411 clockwise or counterclockwise.

As described above, the storage unit 3 includes the first to fifth storage cassettes 31 in the example shown in the drawings. In the following description, a set of the five storage cassettes will be indicated by a reference character "31," while the first, second, third, . . . storage cassettes will be indicated by reference characters "$\mathbf{31}_{-1}$, $\mathbf{31}_{-2}$, $\mathbf{31}_{-3}$, . . . " The number of the storage cassettes 31 is not particularly limited as long as more than one storage cassette 31 is provided. In this example, the five storage cassettes 31 are arranged in a depth direction of the apparatus (a right-left direction in FIG. 2). The second connection path 419 is provided between the fourth storage cassette $\mathbf{31}_{-4}$ and the fifth storage cassette $\mathbf{31}_{-5}$. Although not shown in detail in the drawings, the storage unit 3 can be drawn frontward of the apparatus when the door 133 of the first safe unit 13 is open, and each of the storage cassettes 31 are detachable from the apparatus when the storage unit 3 is drawn forward.

The first to third and fifth storage cassettes $\mathbf{31}_{-1}$, $\mathbf{31}_{-2}$, $\mathbf{31}_{-3}$ and $\mathbf{31}_{-5}$ are configured in almost the same manner, and are narrow in the vertical direction. A port through which the banknotes can pass is formed in an upper surface of each of the storage cassettes 31 to communicate the inside and the outside of the cassette, and the branch path 417 or the second connection path 419 is connected to the port. A passage sensor 312 which detects the banknotes passing through the port when they are stored or fed, and a table 311 which ascends or descends depending on the amount of the banknotes stacked thereon, are provided in each of the storage cassettes 31. Thus, each of the first to third and fifth storage cassettes $\mathbf{31}_{-1}$, $\mathbf{31}_{-2}$, $\mathbf{31}_{-3}$ and $\mathbf{31}_{-5}$ is configured to stack the banknotes sent to the inside of the cassette from the looped transport path 411 through the port on the table 311 in the order from bottom to top, and to feed the banknotes stacked on the table 311 out of the cassette one by one in the order from top to bottom through the port, i.e., to the looped transport path 411.

The fourth storage cassette $\mathbf{31}_{-4}$ is provided with a divider plate to divide space in the fourth storage cassette $\mathbf{31}_{-4}$ into an upper part (an upper fourth storage cassette $\mathbf{31}_{-4U}$) and a lower part (a lower fourth storage cassette $\mathbf{31}_{-4L}$). A port of the upper fourth storage cassette $\mathbf{31}_{-4U}$ is formed in an upper surface thereof, while a port of the lower fourth storage cassette $\mathbf{31}_{-4L}$, is formed in a side surface thereof. The branch path 417 branched from the looped transport path 411 is connected to the port of the upper fourth storage cassette $\mathbf{31}_{-4U}$, and the branch path 4110 branched from the second connection path 419 is connected to the port of the lower fourth storage cassette $\mathbf{31}_{-4L}$. Thus, the upper fourth storage cassette $\mathbf{31}_{-4U}$ is configured to store the banknotes sent to the inside thereof from the looped transport path 411 through the port by stacking the banknotes on the table 311 in the order from bottom to top, and to feed the banknotes stacked on the table 311 one by one to the looped transport path 411 through the port in the order from top to bottom. The lower fourth storage cassette $\mathbf{31}_{-4L}$ is configured to store the banknotes sent to the inside thereof from the looped transport path 411 through the second connection path 419, the branch path 4110, and the port by stacking the banknotes on the table 311 in the order from bottom to top, and to feed the banknotes stacked on the table 311 one by one in the order from top to bottom to the looped transport path 411 through the port, the branch path 4110, and the second connection path 419.

The rejected banknote escrow unit 51 is connected to a third dispensing path 4111. As described in detail later, the escrow unit 51 is a storage unit which temporarily stores the banknotes rejected in the dispensing process, for example. Unlike the stacking storage cassettes 31, the escrow unit 51 is a winding unit. The winding escrow unit includes a tape for guiding the banknotes, a guide, a reel for winding the tape and the banknotes, and a substantially rectangular casing containing the tape, the guide, and the reel as described in Japanese Patent Publication No. 2000-123219. Alternatively, the winding escrow unit 51 includes two tapes for sandwiching the banknotes, a reel for winding the two tapes sandwiching the banknotes, and a casing containing the tapes and the reel as described in International Patent Publication No. WO2011/036782. In either structure, the winding escrow unit winds the banknotes one by one to store them, and feeds the banknotes one by one in a reverse order of the stored order, i.e., the last stored banknote is first fed.

The collection cassette 53 is detachably attached to the second safe unit 14, and is connected to the looped transport path 411 through the second connection path 419 as described above. The collection cassette 53 is a stacking storage unit. However, unlike the storage cassettes 31 described above, the collection cassette 53 is elongated in the depth direction of the apparatus, and includes a note presser (not shown) which moves in the depth direction. The collection cassette 53 is configured to arrange the banknotes in an upright state in the depth direction, and the note presser moves according to the amount of the banknotes.

Unlike the storage cassettes 31, the collection cassette 53 cannot feed the banknotes stored therein. The collection cassette 53 stores some of the banknotes placed in the inlet 211 in the depositing process, but cannot be stored in the storage unit 3, i.e., overflowed banknotes, for example. The banknotes which were unrecognizable and rejected in the dispensing process, etc. may also be stored in the collection cassette 53.

Figure 3:
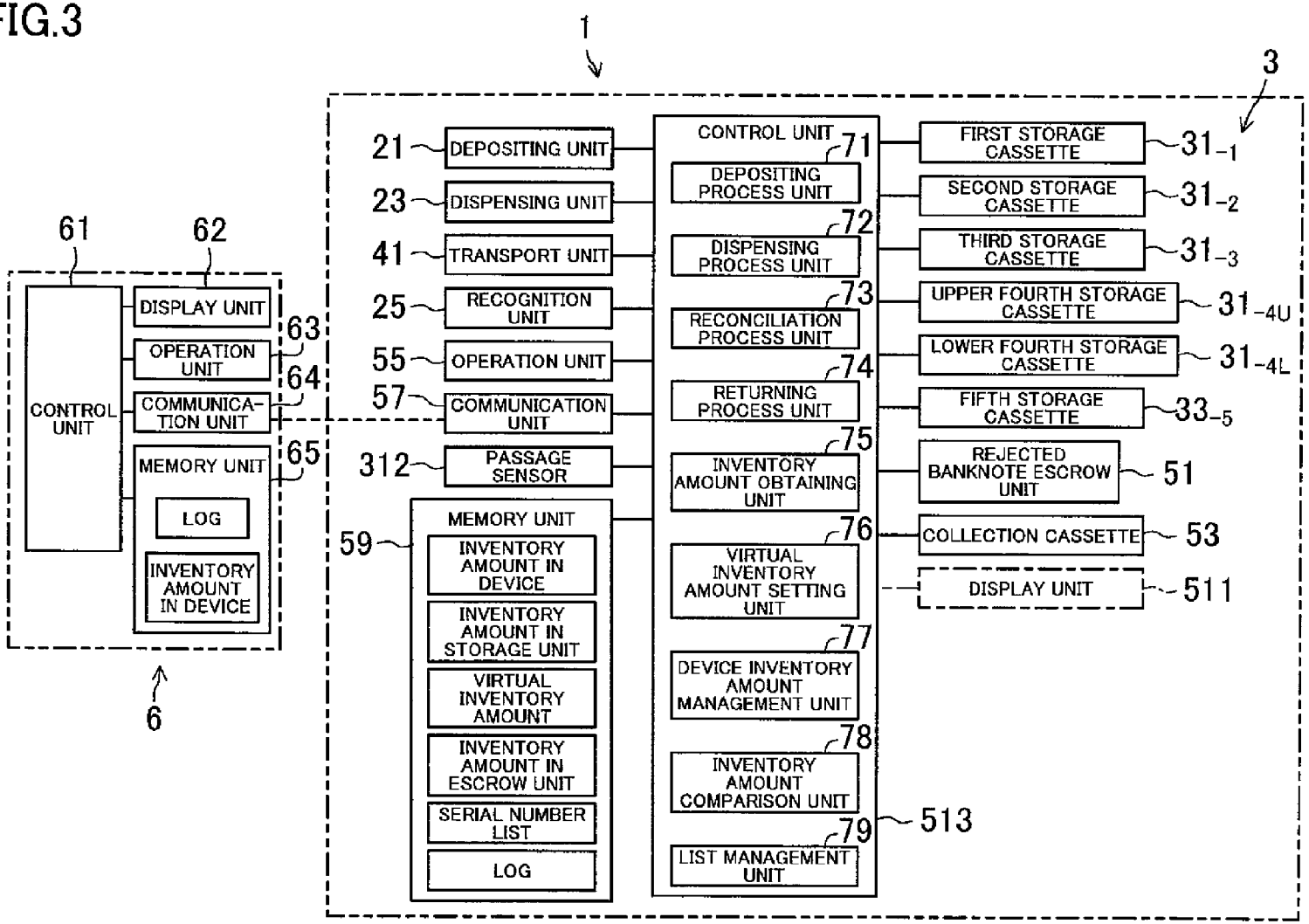
FIG. 3 is a diagram related to control of the banknote depositing/dispensing machine and a higher-ranking device.

FIG. 3 shows a structure associated with control of the depositing/dispensing machine 1. The depositing/dispensing machine 1 includes a control unit 513 which may basically be comprised of a well-known microcomputer. The control unit 513 is connected to the depositing unit 21, the dispensing unit 23, the storage unit 3 including the first to fifth storage cassettes 31, the rejected banknote escrow unit 51, the collection cassette 53, and the transport unit 41 so that signals can be sent and received therebetween. Each of the units 21, 23, 3, 41, 51, and 53 includes a sensor which detects the traveling banknotes, like passage sensors 312 provided at the ports of the storage cassettes 31 and the collection cassette 53, to detect the passage of the banknotes as shown in FIG. 2. Detection signals from the sensors are input to the control unit 513. The control unit 513 outputs control signals based on the input detection signals, and the units 21, 23, 3, 41, 51, and 53 are operated in accordance with the signals.

The control unit 513 is also connected to the recognition unit 25. The recognition unit 25 sends the recognition result and the read serial number to the control unit 513. Although not shown in FIG. 1 etc., the depositing/dispensing machine 1 is also connected to an operation unit 55 as a human interface for an operator of the depositing/dispensing machine 1, such as a teller, a communication unit 57 for sending and receiving signals between a higher-ranking device 6 and other devices through LAN or a serial bus, and a memory unit 59 for storing various types of information, e.g., general-purpose storage devices such as a hard disk drive and a flash memory.

The memory unit 59 stores an inventory amount in device, which is the respective numbers of banknotes of different denominations or the amount of the banknotes stored in the depositing/dispensing machine 1. The inventory amount in device is updated based on a command from the higher-ranking device 6 when the depositing process or the dispensing process is finished. The memory unit 59 also stores an inventory amount of each of the storage cassettes 31 (i.e., an inventory amount in storage unit) and an inventory amount of the rejected banknote escrow unit (i.e., an inventory amount in escrow unit), in addition to the inventory amount in device. Specifically, the inventory amount in storage unit and the inventory amount in escrow unit are increased or decreased since the banknotes are counted in real-time in storing and feeding the banknotes in and from the cassette. As will be described in detail later, in the depositing/dispensing machine 1, the inventory amount of banknotes which are not present in a device of the depositing/dispensing machine 1, but should be treated as banknotes present in the device is regarded as a virtual inventory amount, and is stored in the memory unit 59.

Further, the depositing/dispensing machine 1 is configured to manage the banknotes using the serial numbers. The memory unit 59 stores a serial number list (i.e., a code list) in which the serial numbers of the banknotes stored in each unit are arranged in the stored order, and each of the serial numbers is associated with a consecutive number corresponding to the number of the stored banknotes (see also FIG. 7). How the banknotes are managed using the serial numbers will be described in detail later.

The depositing/dispensing machine 1 may be provided with an optional display unit 511 made of a flat panel display, for example, for displaying various types of information. The display unit 511 is also connected to the control unit 513. The display unit 511 may be a touch panel display, and the display unit 511 may be integrated with the operation unit 55.

The control unit 513 controls the units 21, 23, 25, 3, 41, 51, 53, 55, 57, 59, and 511 based on a command sent from a higher-ranking device 6 through the communication unit 57, and/or various commands received through the operation unit 55. Thus, the depositing/dispensing machine 1 performs various processes including a depositing process, a dispensing process, and a reconciliation process described below. That is, the control unit 513 includes a depositing process unit 71, a dispensing process unit 72, a reconciliation process unit 73, and a returning process unit 74, as functional units for performing a depositing process, a dispensing process, a reconciliation process, and a returning process described later. The control unit 513 further includes an inventory amount obtaining unit 75 as a functional unit for obtaining the inventory amount in storage unit, etc., a virtual inventory amount setting unit 76 as a functional unit for setting the virtual inventory amount, and a device inventory amount management unit 77 as a functional unit for managing the inventory amount in device. Further, as will be described in detail later, the control unit 513 includes an inventory amount comparison unit 78 as a functional unit for comparing the inventory amount in device managed by the device inventory amount management unit 77 and the inventory amount determined in the reconciliation process by the reconciliation process unit 73, and a list management unit 79 as a functional unit for managing a serial number list. The processes performed by the depositing/dispensing machine 1 are stored as a log in the memory unit 59.

As shown in FIG. 3, the higher-ranking device 6 includes a control unit 61, a display unit 62, an operation unit 63, a communication unit 64, and a memory unit 65. The display unit 62 displays various information, etc., to an operator (e.g., a teller), who operates the operation unit 63 to input the various information, etc., to the control unit 61. The communication unit 64 sends and receives signals to and from various types of devices including the depositing/dispensing machine 1. The memory unit 65 stores various information, and the information stored therein includes a record (i.e., a log) of the processes including processes performed using the depositing/dispensing machine 1 (e.g., the depositing process and the dispensing process). Further, as will be described later, the memory unit 65 also stores information on the inventory amount in device which is sent from the depositing/dispensing machine 1.

(Depositing Process)

The depositing process is a process for depositing (i.e., storing) the banknotes in the depositing/dispensing machine 1, and is performed by the depositing process unit 71. In the depositing process, each of the banknotes placed in the inlet 211 is stored in any of the storage cassettes 31 based on the results of the recognition by the recognition unit 25, and the predetermined types (denomination, fitness, etc.) of the banknotes allocated to the storage cassette 31. More specifically, the depositing/dispensing machine 1 performs the depositing process in the following manner. When the banknotes are placed in the inlet 211, a command to start the depositing process is input to the depositing/dispensing machine 1 by operating the higher-ranking device 6 and/or the operation unit 55. As indicated by solid arrows in FIG. 4, the feeding mechanism of the depositing unit 21 feeds the banknotes in the inlet 211 one by one, and the transport unit 41 transports the banknotes to the recognition unit 25. The recognition unit 25 recognizes and counts the banknotes. At this time, the recognition unit 25 reads the serial numbers in real-time.

Figure 4:
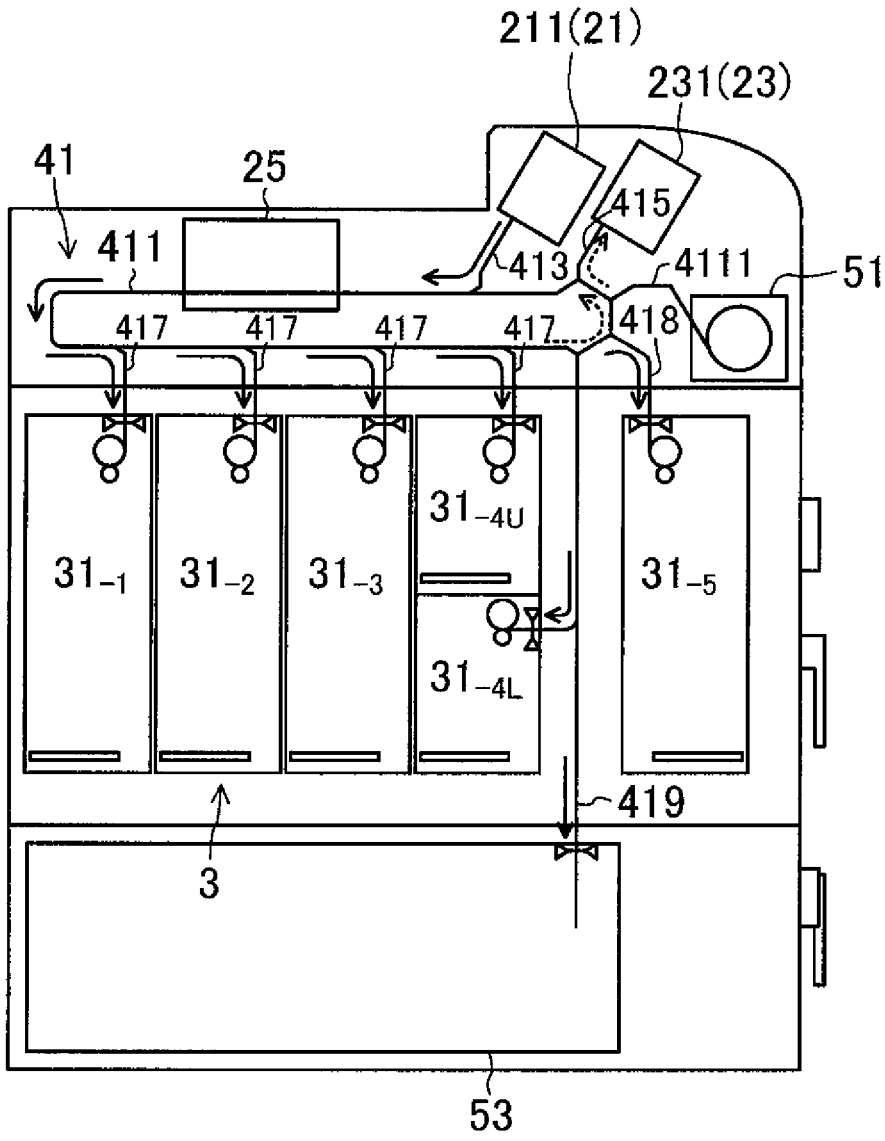
FIG. 4 is a diagram for explaining a depositing process of the banknote depositing/dispensing machine.

The transport unit 41 transports the banknotes which are recognized as acceptable by the recognition unit 25 (the acceptable banknotes will be referred to as normal banknotes in contrast with the rejected banknotes), and all digits of the serial numbers of which are read, to the predetermined storage cassette 31 based on the recognition results and the predetermined types of the banknotes allocated to the storage cassette as indicated by solid arrows in FIG. 4. Specifically, each of the banknotes is stored in any one of the first to fifth storage cassettes 31 based on the denomination or fitness. Thus, in the depositing/dispensing machine 1, the banknotes are directly stored in the storage cassette 31 in the depositing process. The inventory amount obtaining unit 75 updates the inventory amount in storage unit as the banknotes are stored in the storage cassettes 31. The banknotes (normal banknotes in this case) of the denomination which is not allocated to the storage cassette 31 and unfit banknotes are stored in the collection cassette 53. Normal banknotes are stored in the collection cassette 53 also when the storage cassette 31 to which the banknotes are allocated is full.

The transport unit 41 dispenses the rejected banknotes which cannot be accepted by the depositing/dispensing machine 1, such as the banknotes which cannot be authenticated by the recognition unit 25, to the outlet 231 as indicated by dashed arrows in FIG. 4. The banknotes rejected in the depositing process are placed again in the inlet 211, and are recognized again by the recognition unit 25.

After the depositing process is finished, the device inventory amount management unit 77 updates the inventory amount in device stored in the memory unit 59, based on a command from the higher-ranking device 6. Simultaneously, the list management unit 79 updates the serial number list in which the serial numbers of the banknotes stored in each of the storage cassettes 31 are arranged in the stored order, as the banknotes are stored. The serial numbers are listed in the serial number list in the same order as the banknotes having passed the recognition unit 25.

All the banknotes (normal banknotes in this case) placed in the inlet 211 in the depositing process may be temporarily stored in the escrow unit 51, thereby counting the banknotes, and may be stored in the storage cassettes 31 from the escrow unit 51, based on the operation of the higher-ranking device 6 or the operation unit 55.

(Dispensing Process)

The dispensing process is a process for dispensing the banknotes stored in the depositing/dispensing machine 1, and performed by the dispensing process unit 72. Specifically, the dispensing process is started by specifying the amount of money to be dispensed, using the higher-ranking device 6 and/or the operation unit 55, so that the depositing/dispensing machine 1 will automatically sets a minimum number of denominations and the number of banknotes, or the dispensing process is started by performing a predetermined dispensing operation in which the denominations and the number of banknotes are directly specified. The storage unit 3 feeds the specified number of the banknotes of the specified denomination from the storage cassette 31 storing the banknotes as indicated by solid arrows in FIG. 5. As the banknotes are fed, the inventory amount obtaining unit 75 updates the inventory amount in storage unit. The transport unit 41 transports the fed banknotes to the recognition unit 25 through the looped transport path 411, and the recognition unit 25 recognizes the banknotes and reads the serial numbers of the banknotes. Then, the normal banknotes are dispensed to the outlet 231.

Figure 5:
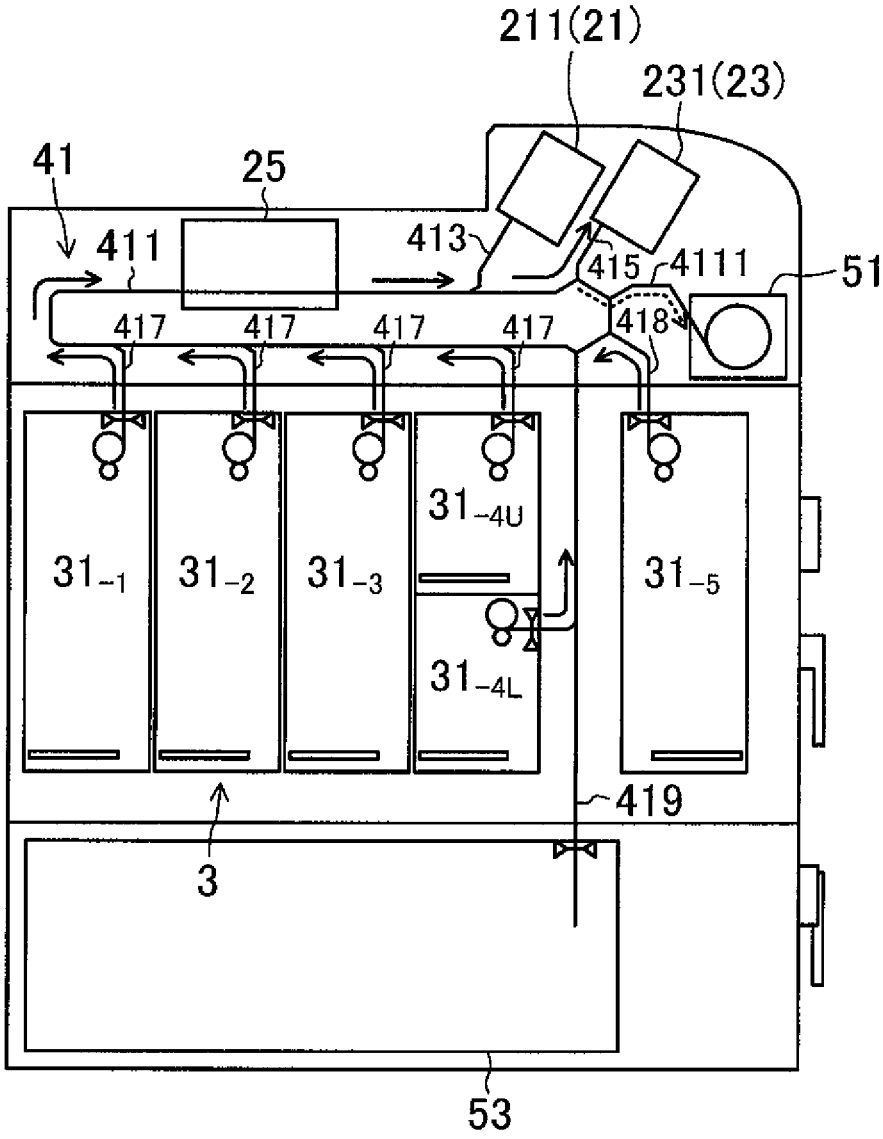
FIG. 5 is a diagram for explaining a dispensing process of the banknote depositing/dispensing machine.

When the banknotes are not recognizable by the recognition unit 25 and are rejected in the dispensing process, the rejected banknotes are transported to the rejected banknote escrow unit 51 as indicated by dashed arrows in FIG. 5, and are stored therein. The banknotes whose serial numbers are not read are also stored in the rejected banknote escrow unit 51. The banknotes stored in the escrow unit 51 are stored in the storage cassette 31 or the collection cassette 53 after the dispensing process is finished, if necessary.

After the dispensing process is finished, the device inventory amount management unit 77 updates the inventory amount in device stored in the memory unit 59, based on a command from the higher-ranking device 6. The list management unit 79 also updates the serial number list of each storage cassette 31, as the banknotes are fed.

(Reconciliation Process)

The reconciliation process is a process for identifying the banknotes stored in the storage cassette 31. The depositing/dispensing machine 1 can perform a full reconciliation process of feeding all the banknotes stored in the storage cassette 31, and a partial reconciliation process of feeding some of the banknotes stored in the storage cassette 31. The reconciliation process unit 73 performs both of the full reconciliation process and the partial reconciliation process.

The full reconciliation process is performed when it is detected that the storage cassette 31 is detached from the device, and that its door is once opened. The full reconciliation process is performed because when the storage cassette 31 is opened, some of the banknotes stored therein may be removed, or the order of the banknotes may be changed, i.e., the number or the order of the banknotes stored in the opened storage cassette 31 may be uncertain. The full reconciliation process is also performed when the storage cassette 31 is replaced. The full reconciliation process is also performed when, although the banknotes in the storage cassette 31 have been identified, the higher-ranking terminal sends a command to execute the full reconciliation process so that the banknotes are identified again by counting the banknotes and reading the serial numbers of the banknotes again. The full reconciliation process may be performed on a single storage cassette 31, or may sequentially be performed on all the storage cassettes 31.

Figure 6:
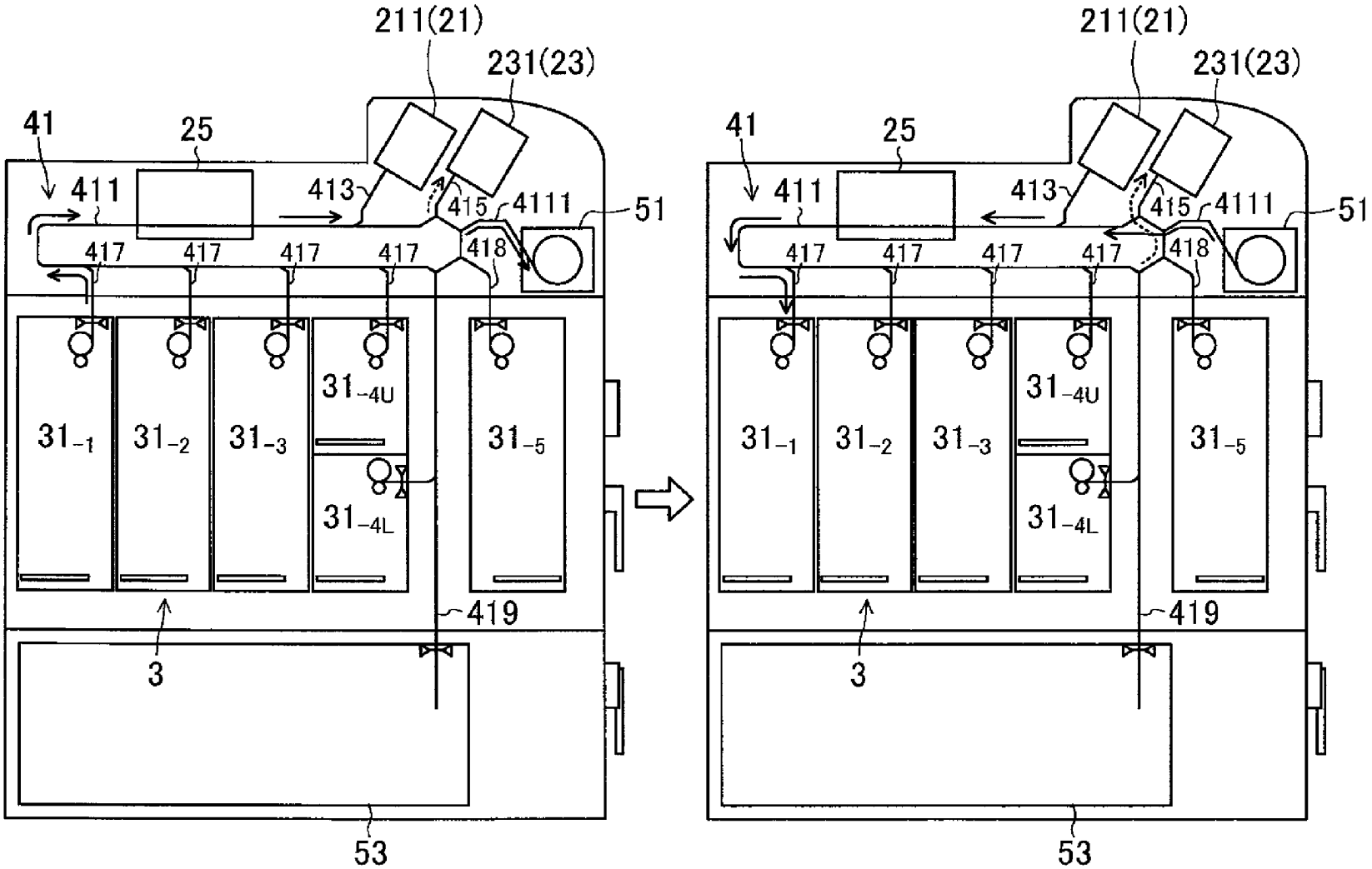
FIG. 6 is a diagram for explaining a reconciliation process of the banknote depositing/dispensing machine.

In the full reconciliation process, as shown in the left side of the white arrow in FIG. 6, the banknotes are fed one by one from the target storage cassette 31 (the first storage cassette $\mathbf{31}_{-1}$ is the target in the example shown in FIG. 6). The transport unit 41 transports the fed banknotes to the recognition unit 25 through the looped transport path 411, and the recognition unit 25 recognizes and counts the banknotes, and reads the serial numbers of the banknotes. The banknotes which have been recognized as the normal banknotes and all digits of the serial numbers of which have been read are transported to the escrow unit 51 as indicated by solid arrows in FIG. 6, and stored therein. The rejected banknotes are transported to the outlet 231 as indicated by dashed arrows in FIG. 6, and dispensed therein.

After all the banknotes stored in the target storage cassette 31 are fed and counted, the banknotes stored in the escrow unit 51 are fed one by one, and transported to the recognition unit 25 through the looped transport path 411 as shown in the right side of the white arrow in FIG. 6. Thus, the recognition unit 25 recognizes and counts the banknotes again, and reads the serial numbers of the banknotes again. Then, the normal banknotes are stored in the original storage cassette 31 again, i.e., the target storage cassette 31. Thus, the banknotes stored in the storage cassette 31 are identified. The device inventory amount management unit 77 and the inventory amount obtaining unit 75 respectively update the inventory amount in device and the inventory amount in storage unit stored in the memory unit 59. The list management unit 79 updates the serial number list of the storage cassette 31.

The partial reconciliation process is performed when irregular transport occurs while the banknotes are traveling from or to the storage cassette 31. When such irregular transport occurs, the number of the banknotes stored in the storage cassette 31 may be different from the counted number. Thus, the banknotes stored in the storage cassette 31 need to be identified. Examples of the irregular transport include the case where the recognition unit 25 has detected that the banknotes are overlapped in the dispensing process, for example, or the case where the banknotes transported in the depositing process are jammed.

When the banknotes are overlapped in the dispensing process, the number of the banknotes fed from the storage cassette 31 is uncertain, and the inventory amount of the storage cassette 31 after the dispensing process is also uncertain. Thus, the partial reconciliation process is performed on all the storage cassettes 31 from which the overlapped banknotes are fed so that at least the inventory amount of each storage cassette 31 is determined.

When the banknote is jammed in the depositing process, the operator needs to remove the jammed banknote. When the banknote is jammed near the inlet of the storage cassette 31, the banknote which has been determined as being stored in the storage cassette 31 may be removed, and the number of the banknotes in the storage cassette 31 may be different from the counted number. Thus, the reconciliation process needs to be performed on the storage cassette 31 in which the number of the banknotes may have been changed due to the irregular transport.

In the partial reconciliation process, the above-described serial number list is used. Thus, the banknotes stored in the storage cassette 31 can be identified by merely feeding some of the banknotes from the storage cassette 31. As compared with the full reconciliation process, a load of the reconciliation process can be reduced, and time required for the reconciliation process is significantly reduced. Specifically, the banknotes can be specified by reading the serial numbers of the banknotes fed from the storage cassette 31, and the fed banknotes can be identified on the list by checking the read serial number against the serial number list because the serial numbers in the serial number list are arranged in the stored order. This can identify the banknotes which are not fed from the storage cassette 31 and remain in the storage cassette 31.

In the stacking storage cassette 31, however, the order of the banknotes may change in storing the banknotes. In such a case, the order of the banknotes passing the recognition unit 25 does not match the order of the banknotes actually stored in the storage cassette 31. Thus, even when a single banknote is fed from the storage cassette 31, and the serial number thereof is identified, the banknotes remaining in the storage cassette 31 cannot precisely be identified when the order of the banknotes has changed.

In the partial reconciliation process performed by the depositing/dispensing machine 1, the serial numbers of two or more banknotes are checked against the serial number list to identify the banknotes, even when the order of the banknotes has changed. Details of the partial reconciliation process will be described with reference to FIG. 7.

In the partial reconciliation process, the reconciliation process unit 73 feeds at least two banknotes from the target storage cassette 31. In the depositing/dispensing machine 1, the maximum number of the banknotes of which the order may be changed is assumed to be five, and the number of banknotes to be fed is set to five. In reading the serial numbers, described later, all digits or part of the digits of the serial number are read.

The transport unit 41 transports the banknotes fed from the storage cassette 31 to the recognition unit 25 in the same manner as in the full reconciliation process. The recognition unit 25 recognizes the banknotes in real-time. The banknotes which have been recognized as the normal banknotes, and their serial numbers have been read are transported to the escrow unit 51 and stored therein (see the illustration on the left side of FIG. 6). Rejected banknotes are transported to the escrow unit 51. When all digits or part of digits of the serial numbers of the five successive banknotes have been read, and the five successive banknotes are sequentially fed from the storage cassette 31, the feeding of the banknotes from the storage cassette 31 is stopped.

If the recognition unit 25 cannot read the serial number of any banknote, a substitutive banknote is additionally fed from the storage cassette 31. For example, when the third banknote of the fed five banknotes cannot be read, another three banknotes are additionally fed, and the partial reconciliation process is performed on the five successive banknotes beginning from the fourth banknote and including the additionally fed banknotes. If a banknote is rejected, at least five banknotes are additionally fed.

Figure 7:
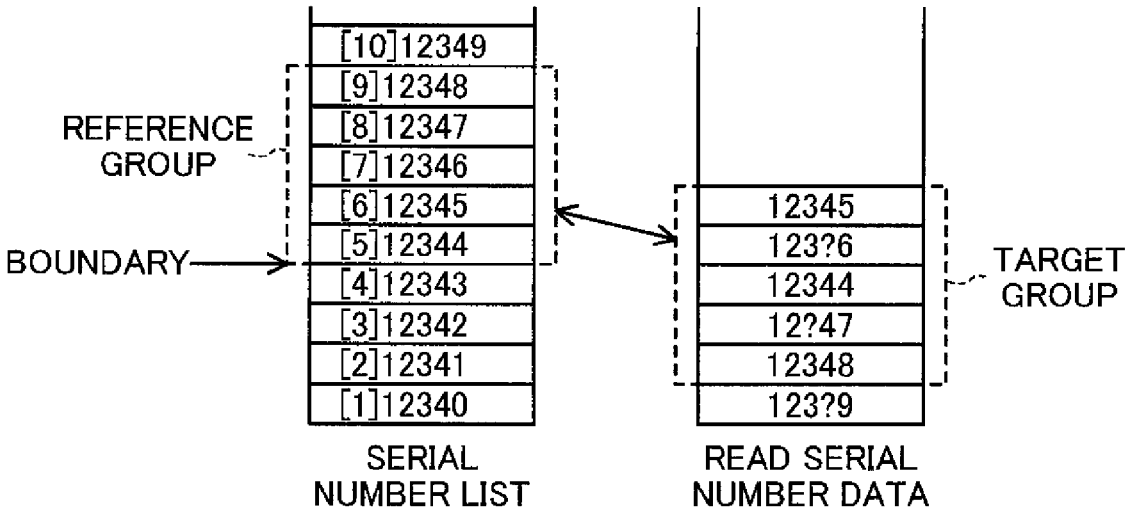
FIG. 7 is a diagram for explaining a partial reconciliation process.

When the target group of five banknotes which will be checked against the serial number list is determined in this way as shown in FIG. 7, the target group is checked against the serial number list, and a group of the serial numbers in the serial number list corresponding to the target group (a reference group) is determined. The order of the serial numbers does not matter. The target group corresponds to the banknotes fed from the storage cassette 31. Accordingly, the reference group indicates a boundary between the banknotes fed from the storage cassette 31 and the banknotes remaining in the storage cassette 31 in the serial number list. Therefore, when the reference group is identified in the serial number list, the banknotes remaining in the storage cassette 31 can be identified based on the serial number list.

Referring to FIG. 7, how the target group is checked against the serial number list will be schematically described. As an example, checking a target group of the serial numbers of the five successive banknotes including the banknote last fed from the storage cassette 31 against the serial number list will be described.

In the serial number list shown in FIG. 7, numbers such as "12340" are serial numbers, and the number shown in an upper column is higher in the stored order. The numbers in the brackets are consecutive numbers of the banknotes in the storage cassette 31, and correspond to the number of the banknotes stored in the storage cassette 31. Read serial number data is data of the serial number read by the recognition unit 25, and data in the upper column corresponds to the banknote fed later, and this data corresponds to the serial numbers arranged in the stored order.

Each of the serial numbers in the target group is checked against the serial numbers in the serial number list, from the higher order serial number, i.e., the serial number of the banknote stacked in an upper level in the storage cassette 31. In this step, the serial number in the target group which is in the highest order in the serial number list is identified. In the example, "12348" is the serial number in the highest order.

The fourth highest serial number from the highest order serial number which has been identified (hereinafter this serial number is referred to as the lowest order serial number) is identified. In the example, "12344" is the lowest order serial number. It is determined whether the serial number which shares all digits with the lowest order serial number is contained in the target group or not. In this case, as well, the order of listing of the serial numbers in the target group does not matter. Three serial numbers between the highest order serial number and the lowest order serial number in the serial number list are checked against the serial numbers in the target group, irrespective of the order. In this checking, it is determined whether the serial numbers share only some of the digits or not. For example, three of the digits of the serial number are masked in the checking. Specifically, even when the serial numbers do not share three digits, it is determined that the serial numbers match each other when the serial numbers share the other digits.

As shown in FIG. 7, a reference group containing all the serial numbers which match the serial numbers in the target group is identified in the serial number list. Based on this result, the serial number list is updated by deleting information of the serial numbers contained in the reference group, and the serial numbers in the order higher than the reference group, from the serial number list. By updating the serial number list in this way, the banknotes remaining in the storage cassette 31 are identified.

Then, as shown in the illustration on the right side of FIG. 6, the banknotes contained in the escrow unit 51 are fed one by one, and transported to the recognition unit 25. The recognition unit 25 recognizes the banknotes, and the normal banknotes whose serial numbers have been read are returned to the original storage cassette 31.

In partial reconciliation, the banknotes are double counted in transferring the banknotes from the storage cassette 31 to the escrow unit 51, and in transferring the banknotes from the escrow unit 51 to the storage cassette 31 (primary counting and secondary counting). By doing so, at least the inventory amount in storage unit stored in the memory unit 59 is updated, and the list management unit 79 updates the serial number list of the target storage cassette 31. Then, the partial reconciliation process is finished.

(Control Related to Error Recovery in the Event of Error During Depositing Process or Dispensing Process)

Control related to error recovery in the event of an error, such as a banknote jam, during execution of the depositing process or the dispensing process will be described with reference to the flow chart in FIG. 8. The flow starts after the start of the depositing process or the dispensing process, and illustrates the case when an error occurs in the first step S1. After the occurrence of the error, the operation of the depositing/dispensing machine 1 is stopped, and although not shown, a screen suggesting error recovery is displayed on the display unit 62 of the higher-ranking device 6, for example. The operator opens the door of the depositing/dispensing machine 1 to remove the jammed banknote in the device (step S2), and presses a reset button (not shown) provided on the depositing/dispensing machine 1 to reset the depositing/dispensing machine 1. In the flow, steps S2 and S3 are repeated until the jammed banknote is removed and the reset completes. When the reset completes, the flow moves from step S3 to step S4. The depositing/dispensing machine 1, on receiving the fact that the reset button has been pressed, notifies the higher-ranking device 6 that the error recovery has been done. The error recovery as used herein corresponds to completing the error recovery in a physical manner, such as removal of jammed banknotes.

If a reconciliation process is necessary after the removal of the jammed banknote, the flow moves from step S4 to step S5 so that the reconciliation process unit 73 performs the partial reconciliation process according to the procedures described above, thereby confirming the uncertain inventory amount B in storage unit. The partial reconciliation process is one of predetermined processes for confirming the inventory amount in storage unit. The inventory amount A in device is not updated yet at the completion of the partial reconciliation process. Thereafter the flow moves to step S6. If the reconciliation process is not necessary, the flow moves from step S4 to step S6, without moving to step S5.

In step S6, the returning process unit 74 performs a returning process. The returning process as used herein is a process of placing, in the inlet 211, the banknotes which are currently outside the device and dispensed to the outside of the device, and storing the banknotes in the storage cassette 31 while counting the banknotes. The returning process, too, is one of predetermined processes for confirming the inventory amount in storage unit. If an error occurs in the depositing process, the banknotes to be placed in the inlet 211 in the returning process includes a banknote intended to be deposited but not yet deposited (i.e., a banknote which remains in the inlet 211 when the process is interrupted), and a banknote, such as a jammed banknote, which has been removed from the device. On the other hand, if an error occurs in the dispensing process, the banknotes to be placed in the inlet 211 in the returning process include a banknote which has been already dispensed in the outlet 231 in the dispensing process (i.e., some of dispensed banknotes present in the outlet 231 when the process is interrupted), a banknote, such as a jammed banknote, which has been removed from the device, and a banknote rejected in the dispensing process (i.e., a banknote stored in the rejected banknote escrow unit 51 and having been dispensed to the outlet 231 prior to the execution of the partial reconciliation process).

In the returning process of step S6, the inventory amount B in storage unit confirmed in step S5 is updated as a result of counting of the banknotes to be stored in the storage cassette 31 using the recognition unit 25 and the passage sensors 312. In the succeeding step S7, the inventory amount comparison unit 78 compares an inventory amount B' in storage unit obtained before the depositing or dispensing process which is interrupted, with the inventory amount B in storage unit after the completion of the returning process in step S6. The inventory amount B' in storage unit and the inventory amount B in storage unit are compared with each other on each of the storage cassettes (or on each denomination).

If the inventory amount B' in storage unit is equal to the inventory amount B in storage unit (B'=B), it is equivalent to not having performed the depositing process and the dispensing process, and the flow moves to step S8 to complete the error recovery.

If the inventory amount B' in storage unit is smaller than the inventory amount B in storage unit (B'<B), it means that the inventory amount B of the banknotes actually stored in the storage unit 3 is larger than the inventory amount B' in storage unit obtained before the process, and therefore, the device inventory amount management unit 77 assumes that the depositing process has been performed, and updates the inventory amount A in device (step S9). Then the flow moves to step S8 to complete the error recovery. In the case where the dispensing process is interrupted, the inventory amounts cannot be B'<B by not accepting more banknotes than the number of banknotes fed to the outlet 231 before the interruption, in the returning process (i.e., dispensing the banknotes to the outlet 231 as rejected banknotes).

On the other hand, if the inventory amount B' in storage unit is larger than the inventory amount B in storage unit (B'>B), it means that the banknotes which used to be in the device is not present in the device for some reasons (e.g., the banknote cannot be returned to the device because the banknote is torn). In such a case, the virtual inventory amount setting unit 76 sets the virtual inventory amount C to C=B'−B in step S10, and the error recovery is completed (step S8). The virtual inventory amount C corresponds to an inventory amount of banknotes which are not present in the device, but should be treated as banknotes present in the device. The device inventory amount management unit 77 manages the sum of the inventory amount B in storage unit and the virtual inventory amount C, as the inventory amount A in device.

By setting the virtual inventory amount, it is possible to save time and effort to prepare a substitutive banknote and store the substitutive banknote in replace of the banknote which cannot be stored, and complete the error recovery immediately, for example. This is advantageous in avoiding delay in business, such as teller's business in financial institutions, and performing the teller's business smoothly.

The inventory amount of the banknotes actually stored in the storage unit 3 is managed as the inventory amount B in storage unit, and the virtual inventory amount C is managed separately from the inventory amount B in storage unit. Therefore, the management of the inventory amount A in device is optimized. By managing the banknotes in this manner, it is possible, particularly in the dispensing process, to accurately determine whether or not the inventory amount A in device is enough to complete the dispensing process (i.e., whether or not there are necessary numbers of banknotes in the device for completing the dispensing process). As a result, it is possible to avoid the situation where the banknotes run short in the dispensing process.

As described above, the depositing/dispensing machine 1 manages the sum of the inventory amount B in storage unit and the virtual inventory amount C, as the inventory amount A in device. However, the depositing/dispensing machine 1 supplies information only about the inventory amount A in device to the higher-ranking device 6 via the communication unit 57. In other words, the device inventory amount management unit 77 of the depositing/dispensing machine 1 sends the information about the inventory amount A in device, without differentiating between the inventory amount B in storage unit and the virtual inventory amount C. Therefore, even if there is a virtual inventory amount C that has been set, the higher-ranking device 6 can perform processes without taking the virtual inventory amount C into account. Unlike this, the depositing/dispensing machine 1 may supply information about all the inventory amount A in device, the inventory amount B in storage unit, and the virtual inventory amount C to the higher-ranking device 6. In other words, the device inventory amount management unit 77 of the depositing/dispensing machine 1 may send the information about the inventory amount A in device to the higher-ranking device 6, while differentiating between the inventory amount B in storage unit and the virtual inventory amount C.

The virtual inventory amount may be set to zero at appropriate timing by depositing the banknotes corresponding to the virtual inventory amount, or by an operator's updating the inventory amount in device by operating the higher-ranking device 6 and/or the operation unit 55 (subtracting the virtual inventory amount from the inventory amount in device).

Now, control related to error recovery will be described with reference to the example in FIG. 9 showing changes in inventory amounts. FIG. 9 shows an example transition of the inventory amounts in the case where the depositing process is interrupted by an error occurred in the depositing process. First, ten 1-dollar bills, twenty 5-dollar bills, thirty 10-dollar bills, forty 20-dollar bills, fifty 50-dollar bills, and sixty 100-dollar bills are deposited in the state where the inventory amount A in device is zero. This depositing process is finished without being interrupted. Therefore, ten 1-dollar bills are stored in a first storage cassette $\mathbf{31}_{-1}$ intended to store 1-dollar bills; twenty 5-dollar bills are stored in a second storage cassette $\mathbf{31}_{-2}$ intended to store 5-dollar bills; thirty 10-dollar bills are stored in a third storage cassette $\mathbf{31}_{-3}$ intended to store 10-dollar bills; forty 20-dollar bills are stored in an upper fourth storage cassette $\mathbf{31}_{-4U}$ intended to store 20-dollar bills; fifty 50-dollar bills are stored in a lower fourth storage cassette $\mathbf{31}_{-4L}$ intended to store 50-dollar bills; and 100-dollar bills are stored in a fifth storage cassette $\mathbf{31}_{-5}$ intended to store 100-dollar bills. At this moment, the inventory amount B in storage unit which is added up every time the banknotes are stored in the storage cassettes 31 in the depositing process, and the inventory amount A in device which is set (or updated) by a command from the higher-ranking device 6 after the depositing process, match each other.

Next, twenty 20-dollar bills are dispensed. In this dispensing process, five 20-dollar bills are recognized as rejected banknotes. Therefore, twenty-five 20-dollar bills in total are fed from the lower fourth storage cassette $\mathbf{31}_{-4U}$ storing the 20-dollar bills, and twenty 20-dollar bills out of the twenty-five 20-dollar bills are dispensed to the outlet 231, and five 20-dollar bills, which are rejected banknotes, are stored in the escrow unit 51. As a result, of the inventory amount B in storage unit, the inventory amount in the lower fourth storage cassette $\mathbf{31}_{-4U}$ is 15 (40 minus 25); the inventory amount D in the escrow unit 51 is five 20-dollar bills; and the inventory amount A in device is twenty 20-dollar bills (that is, the inventory amount A in device of the 20-dollar bills is the sum of the inventory amount B in storage unit and the inventory amount D in escrow unit).

Subsequently, ten 1-dollar bills are deposited. In the depositing process, an error occurs when the passage sensor 312 of the first storage cassette $\mathbf{31}_{-1}$ counts storage of five banknotes. The inventory amount B in the first storage cassette $\mathbf{31}_{-1}$ is fifteen, and the inventory amount A in device of 1-dollar bills remains ten because the depositing process is not completed.

After the error, the error recovery is completed in a physical manner by removing jammed banknote(s), as mentioned above. For example, in the case where the jammed banknotes near the port opening of the first storage cassette $\mathbf{31}_{-1}$ are removed, the inventory amount B in the first storage cassette $\mathbf{31}_{-1}$ is uncertain, and it becomes necessary to perform a reconciliation process (in the example of FIG. 9, the uncertain inventory amount is shown with asterisk).

Since the inventory amount in the first storage cassette $\mathbf{31}_{-1}$ is uncertain, a partial reconciliation process is performed on the first storage cassette $\mathbf{31}_{-1}$. Basically, the banknotes stored in the escrow unit 51 are dispensed to the outlet 231 prior to the reconciliation process because the escrow unit 51 is used in the partial reconciliation process. In this example, however, the five rejected banknotes stored in the escrow unit 51 are not dispensed to the outlet 231 because the five rejected banknotes are stored in the escrow unit 51 before the process in which the error has occurred. Accordingly, the inventory amount D in the escrow unit 51 remains the same.

After that, the partial reconciliation process is performed according to the procedures described above, and as a result, the inventory amount in the first storage cassette $\mathbf{31}_{-1}$ is confirmed 16 banknotes. The inventory amount A in device is not updated at this moment.

A returning process is performed after the partial reconciliation process. In the returning process, 1-dollar bills which have not been deposited yet, and 1-dollar bills taken out from the device (in this example, four 1-dollar bills in total) are placed in the inlet 211. In the returning process, these 1-dollar bills are stored in the first storage cassette $\mathbf{31}_{-1}$ while counting the banknotes. Due to the returning process, the inventory amount in the first storage cassette $\mathbf{31}_{-1}$ (the inventory amount of the 1-dollar bills) is 20 banknotes, i.e., increased by 4 from 16.

After the completion of the returning process, the inventory amount B' in storage unit which is obtained before the start of the process, and the inventory amount B in storage unit at the moment when the partial reconciliation process and the returning process have been finished are compared. In the example of FIG. 9, the inventory amount B' in storage unit is ten 1-dollar bills, whereas the inventory amount B in storage unit is twenty 1-dollar bills, which corresponds to B'<B in step S7 of the flow shown in FIG. 8. In this case, the difference, i.e., ten 1-dollar bills, between the inventory amount B in storage unit and the inventory amount B' in storage unit is deposited in the depositing process, and the inventory amount A in device is updated based on a command from the higher-ranking device 6, for example. In this example, the inventory amount A in device of the 1-dollar bills is updated to twenty 1-dollar bills.

Now, control related to error recovery in the case where the dispensing process is interrupted by an error occurred in the dispensing process will be described with reference to FIG. 10. First, similar in the case in FIG. 9, ten 1-dollar bills, twenty 5-dollar bills, thirty 10-dollar bills, forty 20-dollar bills, fifty 50-dollar bills, and sixty 100-dollar bills are deposited in the state where the inventory amount A in device is zero. Therefore, ten 1-dollar bills are stored in a first storage cassette $\mathbf{31}_{-1}$ intended to store 1-dollar bills; twenty 5-dollar bills are stored in a second storage cassette $\mathbf{31}_{-2}$ intended to store 5-dollar bills; thirty 10-dollar bills are stored in a third storage cassette $\mathbf{31}_{-3}$ intended to store 10-dollar bills; forty 20-dollar bills are stored in an upper fourth storage cassette $\mathbf{31}_{-4U}$ intended to store 20-dollar bills; fifty 50-dollar bills are stored in a lower fourth storage cassette $\mathbf{31}_{-4L}$ intended to store 50-dollar bills; and 100-dollar bills are stored in a fifth storage cassette $\mathbf{31}_{-5}$ intended to store 100-dollar bills. The inventory amount A in device and the inventory amount B in storage unit match each other.

Next, similar to the case of FIG. 9, twenty 20-dollar bills are dispensed. It is also similar to the example of FIG. 9 in that in this dispensing process, five 20-dollar bills are recognized as rejected banknotes and stored in the rejected banknote escrow unit 51. As a result, the inventory amount B in the lower fourth storage cassette $\mathbf{31}_{-4U}$ is 15; the inventory amount D in escrow unit is five 20-dollar bills; and the inventory amount A in device of 20-dollar bills is 20.

Subsequently, ten 1-dollar bills are dispensed. In the dispensing process, an error occurs when the passage sensor 312 of the first storage cassette $\mathbf{31}_{-1}$ counts feed of six banknotes. One of the six 1-dollar bills is rejected. The inventory amount 13 of the first storage cassette $\mathbf{31}_{-1}$ is four, and the inventory amount A in device of 1-dollar bills remains ten because the dispensing process is not completed. Further, the inventory amount D in the escrow unit 51 is one 1-dollar bill. The inventory amount in the first storage cassette $\mathbf{31}_{-1}$ is uncertain after the error recovery is completed in a physical manner by removing the jammed banknote(s).

Since the inventory amount in the first storage cassette $\mathbf{31}_{-1}$ is uncertain, a partial reconciliation process is performed on the first storage cassette $\mathbf{31}_{-1}$. Of the rejected banknotes stored in the escrow unit 51, the banknote rejected in the process (one 1-dollar bill in this case) is dispensed to the outlet 231 to perform the partial reconciliation process. After that, the partial reconciliation process is performed according to the procedures described above, and as a result, the inventory amount in the first storage cassette $\mathbf{31}_{-1}$ is confirmed four banknotes. Thus, six 1-dollar bills are present outside the device, as the sum of 1-dollar bills (including the rejected banknote) which have already been dispensed to the outlet 231 and 1-dollar bills removed from inside the device.

In the succeeding returning process, basically six 1-dollar bills are placed in the inlet 211 as described above. In this example, however, one of the six 1-dollar bills is not placed in the inlet 211 for some reason, and five 1-dollar bills are placed in the inlet 211. These five 1-dollar bills are stored in the first storage cassette $\mathbf{31}_{-1}$, while counting the banknotes. Thus, due to the returning process, the inventory amount B in the first storage cassette $\mathbf{31}_{-1}$ (the inventory amount of 1-dollar bills) is 9 banknotes, i.e., increased by 5 from 4.

After the completion of the returning process, the inventory amount B' in storage unit which is obtained before the start of the process, and the inventory amount B in storage unit at the moment when the reconciliation process and the returning process have finished are compared. The inventory amount B' in storage unit is ten 1-dollar bills, whereas the inventory amount B in storage unit is nine 1-dollar bills, which corresponds to B'>B in step S7 of the flow shown in FIG. 8. The difference, i.e., one 1-dollar bill, between the inventory amount B' in storage unit and the inventory amount B in storage unit is set as a virtual inventory amount C, and the inventory amount A in device of the 1-dollar bills remains ten.

In the above example in which the depositing process is interrupted by an error occurred in the depositing process, a case in which no virtual inventory amount is set is illustrated. However, the virtual inventory amount may sometimes be set after the interruption of the depositing process in the cases, for example, where a banknote is jammed at a port opening of the storage unit 3, and where the operator takes out banknotes more than necessary from the storage unit by mistake.

In the case, for example, where a dispensing process is interrupted by an error occurred in the dispensing process, and the operator places banknotes more than necessary in the inlet by mistake in the returning process, the inventory amounts are B'<B, and it is determined that a depositing process has been performed, and the inventory amount A in device may be updated.

Figure 8:
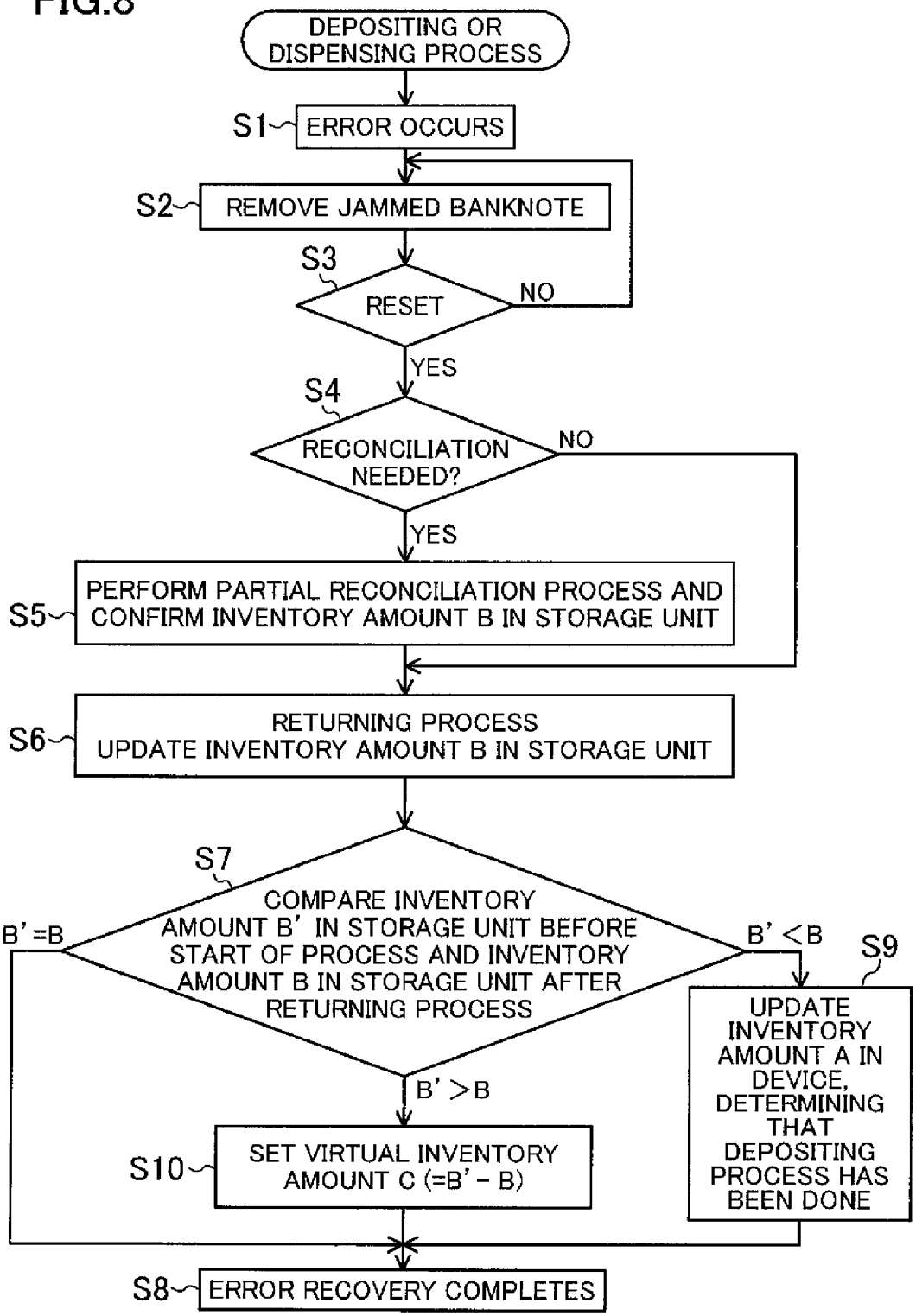
FIG. 8 is a flow chart showing the order of error recovery control.

In the above configurations, the returning process is always performed in step S6 of the flow chart shown in FIG. 8. However, the returning process may be omitted. The omission of the returning process may increase the virtual inventory amount, but even if the virtual inventory amount is increased, the inventory amount in device can be appropriately managed. In step S5 of the flow chart shown in FIG. 8, the partial reconciliation process may be replaced with the full reconciliation process.

The techniques disclosed herein can be widely applied to various depositing/dispensing machines in addition to depositing/dispensing machines used in financial institutions, etc.

Further, the techniques disclosed herein may be applied to coin depositing/dispensing machines, or may be applied to money (including banknotes and coins) depositing/dispensing machines, in addition to banknote depositing/dispensing machines.

The present disclosure is not limited to the above-described embodiments, and can be used in various ways unless otherwise deviated from the spirits and the features of the present disclosure. The above-described embodiments are merely examples in various points, and should not be interpreted solely based on the embodiments described above. The scope of the present disclosure is described by the claims, and is not limited by the specification. Further, variations and modifications belonging to a range equivalent to the range of the claims are within the scope of the present disclosure.

What is claimed is:

1. A money depositing/dispensing device which performs at least a depositing process and a dispensing process of money, comprising:

at least one storage unit provided in the money depositing/dispensing device and configured to store the money and feed the stored money;

an inventory amount obtaining unit configured to count the money to be stored in the storage unit and count the money fed from the storage unit, thereby successively obtaining an inventory amount in the storage unit;

a virtual inventory amount setting unit configured, if there is error money taken out of the money depositing/dispensing device in a recovery process due to an occurrence of an error in the money depositing/dispensing device, and the error money cannot be returned into the money depositing/dispensing device after completion of the recovery process, to set an inventory amount of the error money as a virtual inventory amount as if the error money was money that is present in the money depositing/dispensing device; and a device inventory amount management unit configured to manage, as an inventory amount in the money depositing/dispensing device, a sum of the inventory amount in the storage unit obtained by the inventory amount obtaining unit and the virtual inventory amount set by the virtual inventory amount setting unit.

2. The money depositing/dispensing device of claim 1, further comprising:

an inventory amount confirmation unit configured to confirm the inventory amount in the storage unit by performing a predetermined process; and an inventory amount comparison unit configured to compare the inventory amount in the storage unit obtained by the inventory amount obtaining unit before the inventory amount confirmation unit performs the predetermined process, and an inventory amount in the storage unit confirmed by the predetermined process, wherein if the comparison by the inventory amount comparison unit results in that the inventory amount in the storage unit confirmed by the predetermined process is smaller than the inventory amount in the storage unit obtained by the inventory amount obtaining unit, the virtual inventory amount setting unit sets a difference between the inventory amounts as the virtual inventory amount.

3. The money depositing/dispensing device of claim 2, wherein if the comparison by the inventory amount comparison unit results in that the inventory amount in the storage unit confirmed by the predetermined process is larger than the inventory amount in the storage unit obtained by the inventory amount obtaining unit, the device inventory amount management unit determines that a depositing process equivalent to a difference between the inventory amounts has been performed, and updates the inventory amount in the money depositing/dispensing device.

4. The money depositing/dispensing device of claim 2, wherein the inventory amount confirmation unit performs a reconciliation process for checking the inventory amount in the storage unit by feeding at least part of the money stored in the storage unit, and the predetermined process includes the reconciliation process.

5. The money depositing/dispensing device of claim 4, wherein when the depositing process or the dispensing process is interrupted by an error which occurred in the process, the inventory amount confirmation unit performs the reconciliation process after recovery from a cause of the error.

6. The money depositing/dispensing device of claim 4, wherein after completion of the reconciliation process, the inventory amount confirmation unit performs a returning process in which money present outside the money depositing/dispensing device is placed in an inlet again, and the money placed in the inlet is stored in the storage unit while counting the money, and the predetermined process includes the returning process.

7. The money depositing/dispensing device of claim 4, wherein the money is a banknote, the money depositing/dispensing device further includes a list management unit configured to manage a code list in which unique codes of the respective banknotes are listed in an order of the banknotes stored in the storage unit, and in the reconciliation process, part of the banknotes stored in the storage unit is fed, and the unique codes of the fed banknotes are checked against the code list, thereby checking an inventory amount of the banknotes stored in the storage unit after the feed of the banknotes.

8. The money depositing/dispensing device of claim 1, further comprising:

a communication unit configured to communicate with a higher-ranking device, wherein the device inventory amount management unit sends information about the inventory amount in the money depositing/dispensing device to the higher-ranking device via the communication unit, without differentiating between the inventory amount in the storage unit and the virtual inventory amount.

9. The money depositing/dispensing device of claim 1, further comprising: a communication unit configured to communicate with a higher-ranking device, wherein the device inventory amount management unit sends information about the inventory amount in the money depositing/dispensing device to the higher-ranking device via the communication unit, while differentiating between the inventory amount in the storage unit and the virtual inventory amount.

10. A money management method of a money depositing/dispensing device which performs at least a depositing process and a dispensing process of money, the method comprising:

counting the money to be stored in a storage unit provided in the money depositing/dispensing device and counting the money fed from the storage unit, thereby successively obtaining an inventory amount in the storage unit;

if there is error money taken out of the money depositing/dispensing device in a recovery process due to an occurrence of an error in the money depositing/dispensing device, and the error money cannot be returned into the money depositing/dispensing device after completion of the recovery process, setting an inventory amount of the error money as a virtual inventory amount as if the error money was money that is present in the money depositing/dispensing device; and managing, as an inventory amount in the money depositing/dispensing device, a sum of the obtained inventory amount in the storage unit and the virtual inventory amount which has been set.

11. A money management method of a money depositing/dispensing device which performs at least a depositing process and a dispensing process of money, the method comprising:

counting the money to be stored in a storage unit provided in the money depositing/dispensing device in the depositing process, and counting the money fed from the storage unit in the dispensing process, thereby successively obtaining an inventory amount in the storage unit;

confirming the inventory amount in the storage unit by performing a predetermined process;

comparing the inventory amount in the storage unit obtained before the predetermined process, and an inventory amount in the storage unit confirmed by the predetermined process;

if the comparison identifies that the inventory amount in the storage unit confirmed by the predetermined process is smaller than the inventory amount obtained before the predetermined process, setting a difference between the inventory amounts as a virtual inventory amount of money that is not present in the money depositing/dispensing device but should be treated as money that is present in the device, and managing, as an inventory amount in the device, a sum of the obtained inventory amount in the storage unit and the virtual inventory amount which has been set.

12. The method of claim 11, further comprising:

if the comparison results in that the inventory amount in the storage unit confirmed by the predetermined process is larger than the inventory amount in the storage unit obtained before the predetermined process, determining that a depositing process equivalent to a difference between the inventory amounts has been performed, and updating the inventory amount in the money depositing/dispensing device.

13. The method of claim 11, wherein the confirming of the inventory amount in the storage unit includes a reconciliation process for checking the inventory amount in the storage unit by feeding at least part of the money stored in the storage unit.

14. The method of claim 13, wherein when the depositing process or the dispensing process is interrupted by an error which occurred in the process, the reconciliation process is performed after recovery from a cause of that error.

15. The method of claim 13, wherein after completion of the reconciliation process, a returning process in which money present outside the money depositing/dispensing device is placed in an inlet again, and the money placed in the inlet is stored in the storage unit while counting the money, is further performed.

16. The method of claim 13, wherein the money is a banknote, the method further including:

managing a code list in which unique codes of the respective banknotes are listed in an order of the banknotes stored in the storage unit, and in the reconciliation process, part of the banknotes stored in the storage unit is fed, and the unique codes of the fed banknotes are checked against the code list, thereby checking an inventory amount of the banknotes stored in the storage unit after the feed of the banknotes have been fed.

17. The method of claim 11, further comprising:

sending information about the inventory amount in the money depositing/dispensing device to a higher-ranking device via a communication unit, without differentiating between the inventory amount in the storage unit and the virtual inventory amount.

18. The method of claim 11, further comprising:

sending information about the inventory amount in the money depositing/dispensing device to a higher-ranking money depositing/dispensing device via a communication unit, while differentiating between the inventory amount in the storage unit and the virtual inventory amount.

* * * * *